US010747140B2

(12) United States Patent
Kitamura et al.

(10) Patent No.: US 10,747,140 B2
(45) Date of Patent: Aug. 18, 2020

(54) DEVELOPING APPARATUS, DEVELOPER CARRYING MEMBER, PROCESS CARTRIDGE, AND IMAGE FORMING APPARATUS

(71) Applicant: CANON KABUSHIKI KAISHA, Tokyo (JP)

(72) Inventors: Takuya Kitamura, Yokohama (JP); Kenji Shindo, Yokohama (JP); Kazunari Hagiwara, Yokohama (JP); Takahiro Kawamoto, Yokohama (JP); Ryo Sugiyama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/661,288

(22) Filed: Oct. 23, 2019

(65) Prior Publication Data

US 2020/0133161 A1 Apr. 30, 2020

(30) Foreign Application Priority Data

Oct. 25, 2018 (JP) ..... 2018-200557
Oct. 25, 2018 (JP) ..... 2018-200596

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
CPC ..... G03G 15/0806; G03G 15/0808; G03G 15/0812; G03G 15/09; G03G 15/0921
See application file for complete search history.

(56) References Cited

U.S. PATENT DOCUMENTS 5,783,288 A 7/1998 Fujita
9,256,156 B2 2/2016 Goto
2015/0055990 A1* 2/2015 Koyanagi ..... G03G 15/0822 399/284

(Continued)

FOREIGN PATENT DOCUMENTS

JP S6142672 A 3/1986
JP H04156569 A 5/1992
JP H04311976 A 11/1992

(Continued)

*Primary Examiner* — Hoang X Ngo

(74) *Attorney, Agent, or Firm* — Rossi, Kimms & McDowell LLP

(57) ABSTRACT

A developing apparatus, includes: a developer bearing member configured to bear a developer; and a regulating member that is disposed in contact with a surface of the developer bearing member, and configured to regulate the developer borne on the developer bearing member. On the surface of the developer bearing member, a conductive portion having a first surface roughness and first electric resistance, and a dielectric portion having a second surface roughness, which is smaller than the first surface roughness, and second electric resistance, which is larger than the first electric resistance, are disposed. In a case where the developer borne on the developer bearing member is charged by friction with the regulating member, a charging polarity of the dielectric portion is the same polarity as a charging polarity of the developer.

25 Claims, 15 Drawing Sheets

(56) References Cited

U.S. PATENT DOCUMENTS

2016/0033894 A1* 2/2016 Tokiwa ..... G03G 15/08
399/286

FOREIGN PATENT DOCUMENTS

| | | | |
|---|---|---|---|
| JP | H05289487 | A | 11/1993 |
| JP | H06282160 | A | 10/1994 |
| JP | 2015041084 | A | 3/2015 |
| WO | 2013128551 | A1 | 9/2013 |

* cited by examiner

BEFORE MOVEMENT

AFTER MOVEMENT

DEVELOPING APPARATUS, DEVELOPER CARRYING MEMBER, PROCESS CARTRIDGE, AND IMAGE FORMING APPARATUS

BACKGROUND OF THE INVENTION

Field of the Invention

The present invention relates to an image forming apparatus, such as a printer, a copier and a facsimile, that uses an electrophotographic system or an electrostatic recording system, and a developing apparatus, a developer bearing member, and a process cartridge that are used for the image forming apparatus.

Description of the Related Art

A conventional developing apparatus of an image forming apparatus that uses the electrophotographic image forming process includes: a developer bearing member that bears the developer on the surface and transports the developer; and a developer storing unit that stores the developer. Further, a developing apparatus according to Japanese Patent Application Publication No. S61-42672 includes a developer feeding member that feeds the developer stored in the developer storing unit to the developer bearing member. However in the case where the developing apparatus is close to the end of life, or when the developing apparatus is used under a high temperature high humidity environment, the charge amount of the developer may drop due to deterioration or moisture absorption of the developer. In this case, even if the developer is fed by the developer feeding member using physical force, the charge amount of the developer may be low and the image force with the developer bearing member may become insufficient, making it difficult for the developer bearing member to transport the developer. As a result, a phenomenon where density becomes insufficient in a high print percentage image, such as a solid black image (solid black followability failure), is generated.

To solve this problem, in the developing apparatus according to Japanese Patent Application Publication No. H04-156569, the potential of the developer feeding member is set to a potential between the developer and the developer bearing member in the triboelectric series. Further, the developer bearing member includes a surface layer, in which dielectric portions to form micro-closed electric fields are regularly or irregularly exposed by dispersing insulating particles in a conductive material, on a substrate constituted by a conductor. When the surface layer is rubbed by the developer feeding member or the developer, the dielectric portions are charged to a polarity that is opposite of the charging polarity of the developer. By the triboelectric charging between the dielectric portions of the developer bearing member and the developer feeding member, predetermined charges are provided to the dielectric portions, and an electric field is generated on the charged dielectric portions. In particular, the micro-closed electric field is generated on an adjacent portion between the dielectric portions and the conductive portion, and many micro-closed electric fields are formed on the developer bearing member. The developer is attached to the surface layer by this electric field. Developer, of which charge amount is unstable (charge amount is zero or low) inside the developer container, is transported to the electric field generation region (e.g. many micro-closed electric fields) on the developer bearing member. The transported developer receives the force generated by the micro-closed electric fields (gradient force), and is adsorbed and borne by the dielectric portions which have an opposite polarity of the developer. Thereby an appropriate amount of developer can be transported even in a state where the charge amount of the developer is extremely low, and an image can be outputted with uniform density, even for a high print percentage image, such as a solid black image.

SUMMARY OF THE INVENTION

In the case of the developing apparatus having the configuration disclosed in Japanese Application Publication No. H04-156569, developer, of which charge amount is zero or low, can be transported, and a solid black image followability failure improves, but such an image failure as fogging may be generated because the charge amount of the developer is insufficient at the development position. Fogging is a phenomenon where developer that cannot be charged to a predetermined charge amount is developed when the developer is transported to the development position, even in an electric field of the non-developing region. This phenomenon is generated because the developer attached to the developer bearing member cannot be charged to a predetermined charge amount since the triboelectric charging opportunities, due to the rolling motion, cannot be sufficiently acquired in the charge providing unit (e.g. developing blade).

According to Japanese Application Publication No. H04-156569, the dielectric portions are charged by the rubbing of the developer feeding member and the developer. However in the case where a cumulative number of prints of the developing apparatus is high (e.g. close to end of life) or where the developing apparatus is used under a high temperature high humidity environment, the charge providing amount from the developer to the dielectric portions on the surface of the developer bearing member decreases due to deterioration or moisture absorption of the developer. As a result, charges are provided to the dielectric portions predominantly by the rubbing of the developer feeding member. Hence depending on the contact state between the developer bearing member and the developer feeding member, the charged provided to the dielectric portions become nonuniform. Thereby the gradient force generated by the micro-closed electric fields partially drops. If an image of which print percentage is high is formed at this time, the amount of the developer that is borne and transported on the developer bearing member partially drops. This change in the toner coating amount on the developer bearing member, depending on the charge amount of the dielectric portions of the developer bearing member, may cause such a problem as density nonuniformity in a half tone region. Further, according to the developing apparatus of Japanese Patent Application Publication No. H04-156569, a density difference may be generated in the solid black image to be outputted, which drops uniformity of the density. This is because when the flowability of toner in the developing apparatus drops due to the deterioration of the toner, the toner feeding amount may become different, depending on the number of the dielectric portions in the region in the developer bearing member.

With the foregoing in view, it is an object of the present invention to provide a technique that can suppress a drop in density and the generation of a solid black followability failure using a simple configuration, and suppressing the generation of fogging and density nonuniformity in a half tone region, even if deterioration or moisture absorption of the developer is generated. It is another object of the present invention to provide a technique that can suppress the generation of a solid black followability failure using a simple configuration, and suppress such image problems as fogging and a drop in uniformity of a solid black image, even if deterioration or moisture absorption of the developer is generated.

In order to achieve the object described above, a developing apparatus including:

a developer bearing member configured to bear a developer; and a regulating member that is disposed in contact with a surface of the developer bearing member, and configured to regulate the developer borne on the developer bearing member, wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

In order to achieve the object described above, a developer bearing member configured to bear a developer, including:

a conductive portion having a first surface roughness and first electric resistance, disposed on a surface of the developer bearing member; and a dielectric portion having a second surface roughness, which is smaller than the first surface roughness, and second electric resistance, which is larger than the first electric resistance, disposed on the surface of the developer bearing member, wherein in a case where the developer borne on the developer bearing member is charged by friction with a regulating member, which is disposed in contact with the surface of the developer bearing member and regulates developer borne on the developer bearing member, a charging polarity of the dielectric portion is the same polarity as a charging polarity of the developer.

In order to achieve the object described above, a process cartridge, including:

a developer bearing member configured to bear a developer;

a regulating member that is disposed in contact with a surface of the developer bearing member, and configured to regulate the developer borne on the developer bearing member; and an image bearing member configured to bear a developer image;

wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

In order to achieve the object described above, an image forming apparatus, including:

a developer bearing member configured to bear a developer;

a regulating member that is disposed in contact with a surface of the developer bearing member, and configured to regulate the developer borne on the developer bearing member;

an image bearing member configured to bear a developer image; and a transfer member, wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

In order to achieve the object described above, a developer bearing member configured to bear a developer and that is rotatable, including:

a conductive portion having a first surface roughness and first electric resistance, disposed on a surface of the developer bearing member;

a dielectric portion having a second surface roughness, which is smaller than the first surface roughness, and second electric resistance, which is larger than the first electric resistance, disposed on the surface of the developer bearing member, wherein an average width of the dielectric portion in an axis direction of a rotation axis of the developer bearing member is larger than an average width of the dielectric portion in a rotating direction of the developer bearing member which is orthogonal to the axis direction.

In order to achieve the object described above, a developing apparatus, including:

a developer bearing member configured to bear developer; and a regulating member configured to regulate the developer borne on a surface of the developer bearing member;

wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

In order to achieve the object described above, a process cartridge, including:

a developer bearing member configured to bear developer;

a regulating member configured to regulate the developer borne on a surface of the developer bearing member; and an image bearing member configured to bear a developer image;

wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

In order to achieve the object described above, an image forming apparatus, including:

a developer bearing member configured to bear developer;

a regulating member configured to regulate the developer borne on a surface of the developer bearing member;

an image bearing member configured to bear a developer image; and a transfer member, wherein a conductive portion having a first surface roughness and first electric resistance, and a dielectric portion having a second surface roughness, which is smaller than the first surface roughness, and second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

According to the present invention, in the above mentioned developing apparatus, such problems as fogging or density nonuniformity in the half tone region can be suppressed, while suppressing the generation of a solid black followability failure, even if deterioration or moisture absorption of the developer is generated. Further, according to the present invention, such image problems as fogging and a drop in uniformity of a solid black image can be suppressed, while suppressing the generation of a solid black followability failure, even if deterioration or moisture absorption of the developer is generated.

Further features of the present invention will become apparent from the following description of exemplary embodiments with reference to the attached drawings.

DESCRIPTION OF THE EMBODIMENTS

Embodiments of the present invention will be described with reference to the drawings. The dimensions, materials, shapes and relative positions of components described in the embodiments should be appropriately changed depending on the configurations and various conditions of the apparatus to which the invention is applied, and are not intended to limit the scope of the invention to the following embodiments.

Embodiment 1

Figure 2:
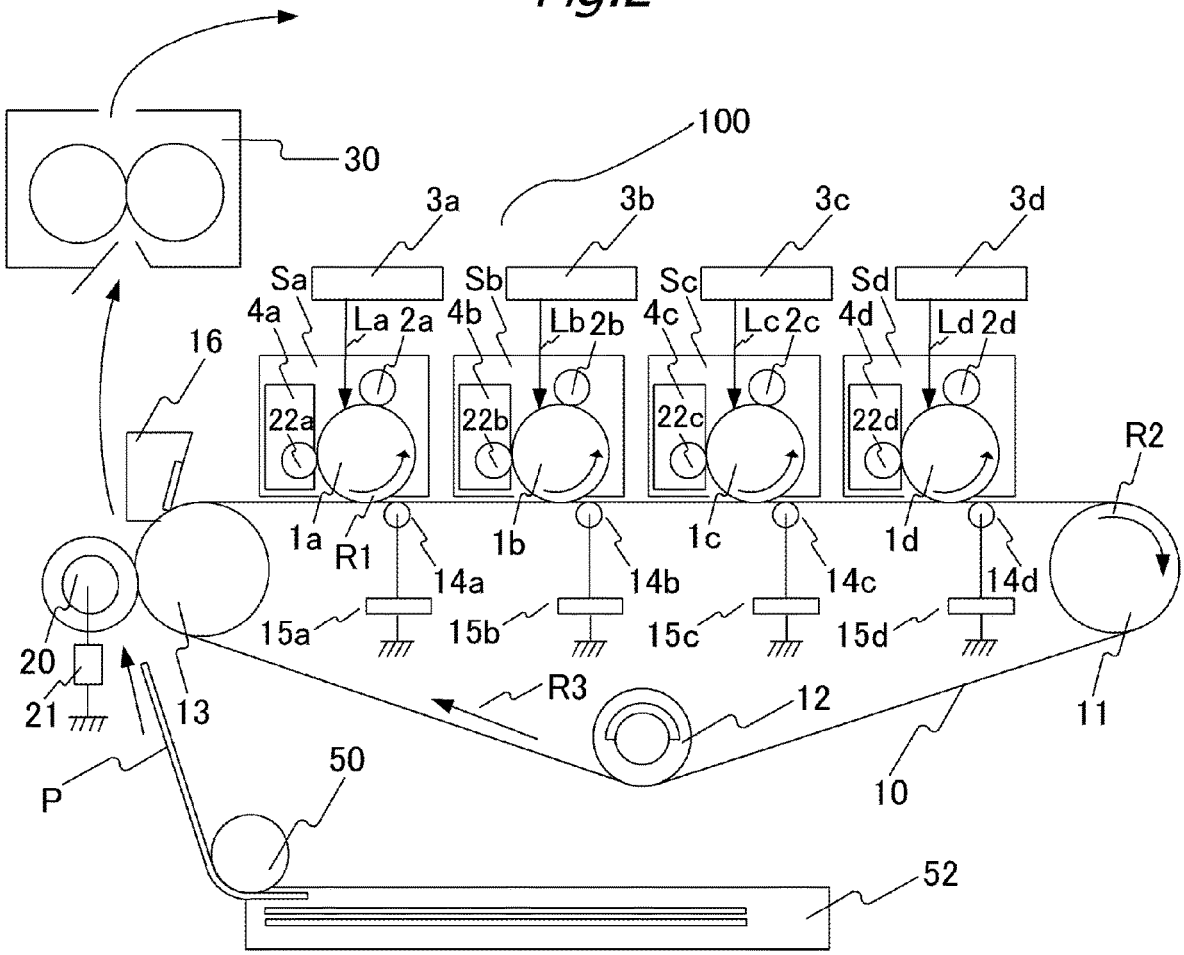
FIG. 2 is a schematic cross-sectional view of an image forming apparatus according to Embodiment 1.

Embodiment 1 of the present invention will be described. First a general configuration of an electrophotographic image forming apparatus (hereafter called image forming apparatus) according to Embodiment 1 will be described. FIG. 2 is a schematic cross-sectional view of the image forming apparatus 100 of Embodiment 1.

The image forming apparatus 100 of Embodiment 1 is an in-line system full color laser printer, which uses an intermediate transfer system.

The image forming apparatus 100 forms a full color image on a recording material P (e.g. recording paper, plastic sheet) according to image information. The image information is inputted from a host device (e.g. personal computer), which communicates via a connection to an image reading apparatus or the image forming apparatus 100, to the image forming apparatus 100.

The image forming apparatus 100 includes a plurality of image forming units, which are the first, second, third and fourth process cartridges Sa, Sb, Sc and Sd for forming an image of yellow (Y), magenta (M), cyan (C) and black (K) respectively. In Embodiment 1, the first to fourth process cartridges Sa, Sb, Sc and Sd are disposed in a line in a direction crossing the vertical direction (upward direction on paper). In Embodiment 1, the configuration and operation of the first to fourth process cartridges Sa, Sb, Sc and Sd are essentially the same, except that the color of the image to be formed is different. Hence in the following, the process cartridge is described in general, omitting the suffixes a, b, c and d which indicate each color of the process cartridge unless distinction is required.

In Embodiment 1, the image forming apparatus 100 includes a plurality of image bearing members, which are four drum type electrophotographic photosensitive members (photosensitive drums) 1 (1*a*, 1*b*, 1*c*, 1*d*), disposed in a direction crossing the vertical direction. The photosensitive drums 1 are rotated by a drive unit (drive source), which is not illustrated. Around each photosensitive drum 1, a charging roller 2 (2*a*, 2*b*, 2*c*, 2*d*), a scanner unit (exposing apparatus) 3 (3*a*, 3*b*, 3*c*, 3*d*) and a developing unit (developing apparatus) 4 (4*a*, 4*b*, 4*c*, 4*d*) are disposed respectively. The charging roller 2 is a charging unit which uniformly charges the surface of the photosensitive drum 1. The scanner unit 3 is an exposing unit which forms an electrostatic image (electrostatic latent image) on the photosensitive drum 1 by irradiating a laser based on the output computed by the CPU (not illustrated) using the image information inputted from a host device (e.g. personal computer). The developing unit 4 is a developing unit which develops an electrostatic image as a developer (hereafter called toner) image. The photosensitive drum 1, the charging roller 2 which is a process unit that acts on the photosensitive drum 1, and the developing unit 4 are integrated into a process cartridge S. The process cartridge S is detachably attached to the image forming apparatus 100 by such installation units as an installation guide and a positioning member in the image forming apparatus 100.

An intermediate transfer belt 10, which is an intermediate transfer member to transfer the toner on each photosensitive drum 1 to the recording material P, is disposed at a position facing each photosensitive drum 1. The intermediate transfer belt 10 is an endless belt, and circulates (rotates) in the arrow R3 direction in FIG. 2 in the state of contacting with each photosensitive drum 1. The intermediate transfer belt 10 passes around a plurality of support members, that is, a secondary transfer counter roller 13, a driver roller 11 and a tension roller 12.

On the inner peripheral surface side of the intermediate transfer belt 5, four primary transfer rollers 14 (14*a*, 14*b*, 14*c*, 14*d*), which are transfer members, are disposed so as to face each photosensitive drum 1. The primary transfer roller 14 presses the intermediate transfer belt 10 toward the photosensitive drum 1, so as to form a primary transfer portion, where the primary transfer belt 10 and the photosensitive drum 1 are in contact.

On the outer peripheral surface side of the intermediate transfer belt 10, a secondary transfer roller 20, which is a secondary transfer unit, is disposed at a position facing a secondary transfer counter roller 13. The secondary transfer roller 20 press-contacts the secondary transfer counter roller 13 via the intermediate transfer belt 10, so as to form a secondary transfer portion, where the intermediate transfer belt 10 and the secondary transfer counter roller 13 are in contact.

The recording material P, onto which the toner image is transferred, is transported to a fixing apparatus 30, which is a fixing unit. In the fixing apparatus 30, heat and pressure are applied to the recording material P, whereby the toner image is fixed to the recording material P. The image forming apparatus 100 can also form a monochrome or multicolor image using one image forming unit or a plurality of (not all of) image forming units. The image forming apparatus 100 according to Embodiment 1 is, for example, a printer of which process speed is 148.2 mm/sec. and which supports A4 size paper.

Image Forming Process

An image forming process by the image forming apparatus 100 will be described next. When an image is formed, the surface of the photosensitive drum 1 is uniformly charged by the charging roller 2. Then the CPU performs arithmetic processing to form an electrostatic image based on the image information which is inputted from an external host device of the image forming apparatus 100. Based on the arithmetic result, the charged surface of the photosensitive drum 1 is exposed by the scanning of a laser beam emitted from the scanner unit 3, and an electrostatic image in accordance with the arithmetic result is formed on the photosensitive drum 1. The electrostatic image formed on the photosensitive drum 1 is developed by the developing unit 4 as a toner image (developer image). Then from a primary transfer voltage power supply 15 (high voltage power supply), which is primary transfer voltage applying unit, voltage, of which polarity is opposite of the regular charging polarity of the toner, is applied to the primary transfer roller 14. Thereby the toner image on the photosensitive drum 1 is primarily transferred onto the intermediate transfer belt 10. In the case of forming a full color image, this processing is sequentially performed by the first to fourth process cartridges Sa, Sb, Sc and Sd, so that the toner image of each color is sequentially superimposed on the intermediate transfer belt 10, and the superimposed image is primarily transferred.

Then the recording material P is transported to the secondary transfer portion synchronizing with the movement of the intermediate transfer belt 10. Then from a secondary transfer voltage power supply 21 (high voltage power supply), which is a secondary transfer voltage applying unit, voltage of which polarity is opposite of the regular charging polarity of the toner is applied to the secondary transfer roller 20. Thereby the four-color toner images on the intermediate transfer belt 10 are secondarily transferred in batch onto the recording material P transported by a feeding unit, by the function of the secondary transfer roller 20, which is in contact with the intermediate transfer belt 10 via the recording material P. The recording material P, on which the toner images are transferred, is transported to the fixing apparatus 30, which is a fixing unit. In the fixing apparatus 30, the transferred toner images are fixed by the heat and pressure applied to the recording material P, and the recording material P is discharged from the image forming apparatus 100.

In order to control the developing amount of the toner, the developing unit 4 performs reversal development by contacting the developing roller 22 and the photosensitive drum 1, while changing the rotation speed of the developing roller 22 (developer bearing member) with respect to the rotation speed of the photosensitive drum 1. In other words, the electrostatic image is developed by attaching toner, which is charged at the same polarity of the charging polarity of the photosensitive drum 1 (negative polarity in Embodiment 1), to the portions on the photosensitive drum 1, where charges are attenuated by the exposure (image portion, exposed portion). In Embodiment 1, the developing roller 22 is driven so that the ratio of the rotation speed of the developing roller 22, with respect to the rotation speed of the photosensitive drum 1, is 1.4, for example.

The toner remaining on the surface of the photosensitive drum 1 in the primary transfer step (untransferred toner) is collected by the later mentioned developing roller 22, and is reused. The untransferred toner on the surface of the photosensitive drum 1 is charged to have a normal charging polarity (negative polarity) while passing through the charging roller 2. Then the untransferred toner is collected by the developing roller 22 via the electric field, which is generated due to the difference between the potential of the photosensitive drum 1 formed by the charging roller 2 and the potential of the developing roller 22 formed by the DC voltage applied to the developing roller 22, and is reused.

Configuration of Process Cartridge

A general configuration of the process cartridge S, which is installed in the image forming apparatus 100 of Embodiment 1, will be described. Each process cartridge S for each color has the same shape except for the identifying portion (not illustrated), and toner or each color: yellow (Y), magenta (M), cyan (C) and black (K) is stored in the developing unit 4 of the process cartridge S for each color respectively. For the toner of the developing unit 4, a non-magnetic one-component developer is used.

The process cartridge S is configured by integrating a photosensitive unit, which includes the photosensitive drum 1 and the charging roller 2, and a developing unit (developing apparatus) 4 which includes the developing roller 22. The charging roller 2 and the developing roller 22 are rotatable around a bearing (not illustrated) of the respective rotation axis.

The photosensitive drum 1 is rotatably supported via the bearing. The photosensitive drum 1 is rotary-driven in the arrow R1 direction in FIG. 2 in accordance with the image forming orientation, by the driving force of the drive unit (drive source), which is not illustrated, that is transferred to the photosensitive unit. The roller portion (conductive rubber) of the charging roller 2 press-contacts the photosensitive drum 1, whereby the charging roller 2 tracks with the rotation of the photosensitive drum 1.

Figure 3:
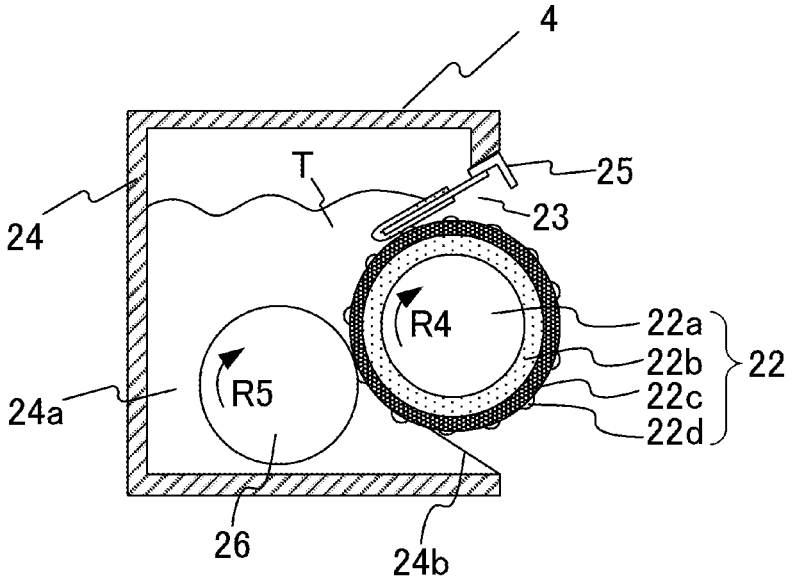
FIG. 3 is a diagram depicting a developing unit according to Embodiment 1.

The developing unit 4, as illustrated in FIG. 3, on the other hand, includes a developing roller 22 which bears toner, a developing blade 23 (regulating member), a feeding member 26 which is disposed to contact the developing roller 22, and a developing frame 24 which fixes these components. The developing frame 24 includes a developing chamber 24*a* in which the developing roller 22 is disposed, and a spill prevention sheet 24*b* which seals the developing opening (opening portion) connecting the developing chamber 24*a* and the outside of the developing frame 24. One end of the developing blade 23 is fixed to the fixing member 25 which is fixed to the developing frame 24, and the other end of the developing blade 23 contacts the developing roller 22. The developing blade 23 is configured so as to regulate the toner coating amount on the developing roller 22, and to provide electric charges. The developing roller 22 is disposed at the developing opening, so as to contact the photosensitive drum 1. The developing roller 22 will be described in detail later. The developing roller 22 is disposed so as to be rotary-driven in the direction indicated by the arrow R4 in FIG. 3.

In Embodiment 1, the developing roller 22 and the photosensitive drum 1 are rotated such that the surfaces of the developing roller 22 and the photosensitive drum 1 facing each other move in the same direction (direction from top to bottom in the gravity direction in Embodiment 1) respectively. Then a predetermined DC voltage is applied to the developing roller 22, and toner charged to have minus polarity by the triboelectric charging is developed to an electrostatic latent image in the developing portion which is in contact with the photosensitive drum 1, whereby the toner image is formed.

As illustrated in FIG. 3, the developing blade 23 contacts the surface of the developing roller 22 in a state where the tip of the developing blade 23 faces in the direction of the counter located on the upstream side of the developing roller 22 in the rotating direction, with respect to the rotating direction of the developing roller 22, so as to regulate the toner coating amount and provide charges. In Embodiment 1, the surface of the developing blade 23 contacts the developing roller 22 using the spring elasticity of a support member (not illustrated) of a SUS plate (plate spring) of which thickness is 50 to 120 μm. In the developing blade 23, one end in the shorter direction is a blade portion, and the other end is fixed to and supported by the developing frame 24. The support member of the developing blade 23 may be a metal thin plate (e.g. phosphor bronze, aluminum), for example, instead of using the SUS plate. The developing blade 23 is formed by coating a thin film of a conductive resin (e.g. polyamide elastomer, urethane rubber, urethan resin) on the surface of the support member. For the developing blade 23, the support member itself may be contacted with the developing roller 22. Further, a predetermined DC voltage is applied to the developing blade 23 as the blade bias to control the potential difference from the voltage applied to the developing roller 22, whereby the toner transporting amount on the developing roller 22 is controlled, as described later. In Embodiment 1, it is assumed that the potential of the developing blade 23, with respect to the potential of the developing roller 22 (reference potential), has the same polarity as the toner.

The feeding member 26 is constituted of a conductive core of which diameter is φ4 (mm), and a flexible urethane sponge layer, which is constituted of an open cell structure, is formed around the core. The outer diameter of the feeding member 26 is φ11 (mm). By using an open cell urethan sponge for the feeding member 26, toner can be stored in the sponge. When the image forming apparatus 100 performs the developing processing, the feeding member 26 is supported by the developing frame 24, so that the feeding member 26 contacts the developing roller 22, and is rotary-driven in the arrow R5 direction in FIG. 3.

Description of Developing Roller 22

Figure 1A:
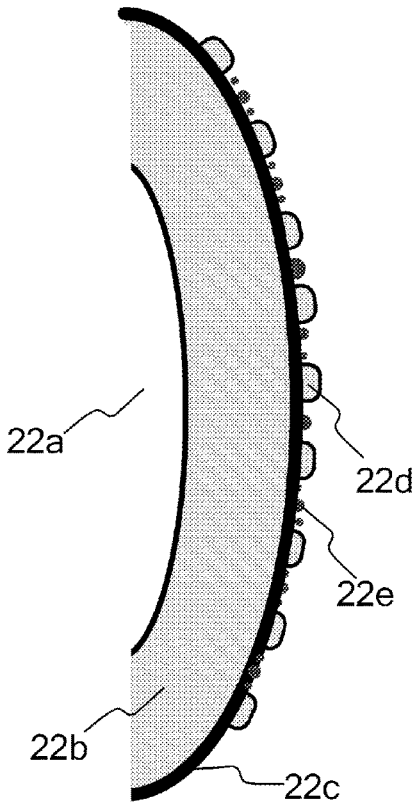
FIG. 1A and FIG. 1B are diagrams depicting a developing roller according to Embodiment 1.

The configuration of the developing roller 22 according to Embodiment 1 will be described in detail with reference to FIG. 1A and FIG. 1B. FIG. 1A is a schematic diagram depicting a cross-section of the developing roller 22 sectioned by a plane that is vertical to the rotation axis. The developing roller 22 has a configuration that is formed by sequentially layering a base layer 22*b*, which is a silicon rubber composition in Table 1, and a surface layer 22*c* formed of urethane in Table 2 on the metal core 22*a*, and coating an insulating coating material formed of the materials in Table 3 on the surface layer 22*c*. A developing bias is applied to the surface layer 22*c* and the base layer 22*b* via the metal core 22*a*.

A manufacturing method, material and dimensions of the developing roller 22 according to Embodiment 1 will be described next.

1. Forming Metal Core 22*a*

The metal core 22*a* is formed, for example, by coating a primer (product name: DY35-051 (manufactured by Dow Corning Toray Co. Ltd.)) on a core (SUS 304), of which outer diameter is 6 mm and length is 259.9 mm, and heating this at 150° C. for 20 minutes.

2. Forming Conductive Elastic Layer

In the developing roller 22, the conductive elastic layer has a one-layer structure or a layered structure that includes two or more layers. It is preferable that the conductive elastic layer has a layered structure that includes two or more layers. Particularly in the nonmagnetic one-component contact development type process, a developing roller having a conductive elastic layer constituted of a two-layer structure is suitably used for the developing roller 22. In Embodiment 1, a conductive elastic layer having a two-layer structure constituted of the base layer 22*b* and the surface layer 22*c* will be described. It is preferable that the conductive elastic layer contains a conductive agent to provide conductivity. For the conductive agent, an electronic conductive agent, such as an ion conductive agent and carbon black is used. The carbon black is preferable as a conductive agent since the conductivity of the conductive elastic layer and the charging performance of the conductive elastic layer for toner can be controlled. The volume resistivity (first elastic resistance) of the conductive elastic layer is preferably in the range of at least 1×10^3 Ω·cm, and not more than 1×10^11 Ω·cm.

2-1. Forming Base Layer 22*b*

To form the base layer 22*b*, the metal core 22*a* is disposed in a cylindrical die of which inner diameter is 10.0 mm, so as to be concentric with the cylinder of the die. As an example of the materials of the base layer 22*b*, the materials listed in Table 1 are mixed by a mixer (product name: Trimix TX-15 (manufactured by Inoue Mfg. Inc.)), and this addition-type silicon rubber composition is injected into the die which is heated to 120° C. The materials injected into the die are heated and molded at 120° C. for 10 minutes, then cooled down to room temperature and released from the die. Then a base layer roller, where a 2.00 mm thick base layer 22*b* is formed on the outer periphery of the axial core is acquired.

TABLE 1

| Material | Parts by mass |
|---|---|
| Dimethylpolysiloxane containing at least two silicon atom-bonded alkenyl groups in one molecule (product name: SF 3000E, viscosity: 10000 cP, vinyl group equivalent: 0.05 mmol/g, manufactured by KCC) | 100 |
| Dimethylpolysiloxane containing at least two silicon atom-bonded hydrogen atoms in one molecule (product name: SP 6000P, Si—H group equivalent: 15.5 mmol/g, manufactured by KCC) | 0.5 |
| Platinum-based catalyst (Product name: SIP 6832.2, manufactured by Gelest) | 0.048 |
| Carbon black (product name: Toka Black # 7360SB, manufactured by Tokai Carbon) | 6 |

2-2. Forming Surface Layer 22*c*

To form the surface layer 22*c*, the materials listed in Table 2 are measured and stir-mixed. Then the acquired mixture is added to and mixed with methyl ethyl ketone (manufactured by Aldrich), so that the solid content concentration becomes a 28 mass %, then is uniformly dispersed using a bead mill (manufactured by Ashizawa Fine Tech), whereby a coating material is acquired. Further, the base layer roller is dipped into this coating material using an overflow type circulation coating machine, so that the film thickness of the surface layer becomes 15 μm. Then the coating film is dried and cured by heating at 130° C. for 90 minutes, whereby the elastic layer roller, where the surface layer 22*c* is formed on the base layer roller, is acquired. The later mentioned surface roughening refers to a region where the surface roughness of the conductive portion 22*e* is controlled by adding the resin particles listed in Table 2.

TABLE 2

| Material | Parts by mass |
|---|---|
| Acrylic polyol (product name: PX41-11, manufactured by Asia Chemical Ind.) | 67 |
| Isocyanate (product name: Duranate SBB-70P, manufactured by Asahi Kasei) | 33 |
| Carbon black (product name: MA100, manufactured by Mitsubishi Chemical) | 20 |
| Modified silicon oil (product name: KF-410, manufactured by Shin-Etsu Chemical) | 1 |
| Resin particles (product name: Daimic Beaz UCN5150D, manufactured by Dainichi Seika Color and Chemicals) | 15 |

3. Forming Dielectric Portions (Dielectric Portion) 22*d*

A plurality of dielectric portions 22*d* exist in a part of the regions on the surface of the developing roller 22. In concrete terms, the surface of the developing roller 22 is constituted at least of surfaces of the plurality of dielectric portions 22*d*, and an exposed portion of the conductive elastic layer which is not coated with the dielectric portions 22*d*. Thus the dielectric portions 22*d* are formed on the surface of the developing roller 22 by coating a part of the surface of the conductive portion 22*e*. The dielectric portions 22*d* are scattered in the region of the conductive portion 22*e*. On the surface of the developing roller 22, the surface area occupied by the dielectric portions 22*d* is smaller than the surface area occupied by the conductive portion 22*e*. It is preferable that the volume resistivity (second electric resistance) of the dielectric portions 22*d* of the developing roller 22 is at least 1×10^13 Ω·cm and not more than 1×10^18 Ω·cm. In other words, in Embodiment 1, the electric resistance of the dielectric portions 22*d* is larger than the electric resistance of the conductive portion 22*e*.

To form the dielectric portions 22*d*, the materials listed in Table 3 are measured and stir-mixed. Then the acquired mixture is dissolved and mixed in methyl ethyl ketone (manufactured by Aldrich), so that the solid content concentration becomes a 3 mass %, whereby coating material for forming the dielectric portions is acquired.

Various printing methods are possible to form the dielectric portions 22*d* on the conductive elastic layer, but the jet dispense method or the ink jet method is preferable to dispose a plurality of dielectric portions 22*d* in a part of the regions on the surface of the conductive elastic layer. On the surface layer 22*c*, a portion that is exposed without the dielectric portions 22*d* being formed are called the conductive portion 22*e*. In Embodiment 1, the dielectric portions 22*d* are formed by the jet dispenser method. Further, in Embodiment 1, when the developer borne on the developing roller 22 is charged by fiction with the developing blade 23, the charging polarity of the dielectric portions 22*d* is the same polarity as the charging polarity of the developer (negative polarity in Embodiment 1).

TABLE 3

| Material | Parts by mass |
|---|---|
| Ester polyol (product name: F1010, manufactured by Kuraray) | 60 |
| Isocyanate (product name: Vestanat B1370, manufactured by Degussa) | 40 |

Roughness of Conductive Elastic Layer and Dielectric Portion

The surface roughness of the dielectric portion 22*d* is different from the surface roughness of the conductive portion 22*e*. In concrete terms, the surface roughness Ray of the dielectric portion 22*d* is lower, that is, smoother, than the surface roughness Rad of the conductive portion 22*e*. As a result of the study by the present inventors, it is preferable that the surface roughness of the conductive portion 22*e* (first surface roughness) is 0.8 μm<Rad<2.7 μm, and the surface roughness of the dielectric portion 22*d* (second surface roughness) is Ray<0.8 μm (less than 0.8 μm). In Embodiment 1, the dielectric portion 22*d* does not contain resin particles, but the conductive portion 22*e* contains resin particles. This generates the difference of the surface roughness between the dielectric portion 22*d* and the conductive portion 22*e*.

The later mentioned toner charge providing function is performed by a regulating portion, and charges are provided by the rolling motion of the toner between the conductive portion 22*e* of the developing blade 23. In other words, toner is charged on the conductive portion 22*e* by quickly transporting the toner on the dielectric portions 22*d* to the conductive portion 22*e* that is on the downstream side of the developing roller 22 in the rotating direction of the developing roller 22. In the case where the surface roughness of the dielectric portion 22*d* is 0.8 μm or more, toner borne on the developing roller 22 increases, and toner that has no opportunities to be charged by the conductive portion 22*e* is generated, and as a result, the toner charge providing function diminishes. In the case where the surface roughness of the conductive portion 22*e* is 2.7 μm or more, as well, toner borne on the developing roller 22 increases and the toner charge providing function diminishes, which is not desirable.

Method of Measuring Surface Roughness of Dielectric Portion and Conductive Portion In Embodiment 1, the surface roughness Ray of the dielectric portion 22*d* and the surface roughness Rad of the conductive portion 22*e* are measured as follows.

An object lens of which magnification is 20 is installed in a laser microscope (product name: VK-X100, manufactured by Kenence). Then using the image connecting function of this microscope, a 1.5 mm×1 mm region on the surface of the developing roller 22 is two-dimensionally scanned by the confocal optical system of the laser, whereby the image of the surface of the developing roller 22 and the height information thereof can be acquired. Here a 900 μm square region (evaluation region) is regarded as an evaluation target.

Based on this height information, inclination is corrected in the secondary curve correction mode, then dielectric portions 22*d* are extracted. Here measurement targets are the dielectric portions 22*d*, which are included in the evaluation region in total, and dielectric portions 22*d*, which are not partially included in the evaluation region, are outside of the measurement targets. The evaluation is performed in a mode in which surface roughness is measured using analysis software bundled with the measurement instrument, and the surface roughness Ray in the evaluation region is calculated. For the surface roughness of the conductive portion 22*e*, the evaluation region from which the dielectric portions 22*d* are removed is extracted, and the surface roughness Rad is calculated for the extracted region in the same manner as the calculation of the surface roughness of the dielectric portions 22*d*.

An average value Sy of the widths of the dielectric portions 22*d* in the rotary-driving direction of the developing roller 22 (hereafter called average dielectric portion width Sy) is 60 μm in the case of the developing roller 22 used for Embodiment 1. The evaluation method will be described next.

Method of Measuring Average Dielectric Portion Width

In the present invention, the average dielectric portion width Sy in the rotating direction of the developing roller 22 is measured as follows. An objective lens of which magnification is 10 is installed in a laser microscope (product name: VK-X100, manufacture by Keyence), then a 1.5 mm×1 mm region on the surface of the developing roller 22 is two-dimensionally scanned by the confocal optical system of the laser. Thereby a high contrast image on the surface of the developing roller 22 can be acquired. Then in the acquired image, a 900 μm square region (evaluation region) is regarded as an evaluation target.

Then the dielectric portions 22*d* are extracted from the image in the evaluation region, and the image is binarized. The acquired binary image is analyzed, and the number of pixels is calculated for the dielectric portions 22*d* that are continuous in the rotating direction of the developing roller 22. Then an average value of the calculated numbers of pixels is calculated, and the average dielectric portion width Sy is calculated based on the resolution. Further, the average width Sx of the dielectric portions in the direction that is orthogonal to the rotating direction of the developing roller 22, that is, the direction (axis direction) of the rotation axis of the developing roller 22, is calculated. Analyzing the binary image acquired in the above process, the number of pixels is calculated for the dielectric portions 22*d* that are continuous in the direction of the rotation axis of the developing roller 22. Then an average value of the calculated numbers of pixels is calculated, and the average width Sy of the dielectric portions is calculated based on the resolution. In Embodiment 1, it is assumed that the average dielectric portion width Sy in the rotating direction of the developing roller 22 is 100 μm, and the average dielectric portion width Sx in the rotation axis direction of the developing roller 22 is 140 μm. In other words, Sx/Sy=1.4 is established.

In Embodiment 1, toner coating amount is regulated and toner is charged by the surface of the developing blade 23 contacting the developing roller 22. The portion where the toner coating amount is regulated and the toner is charged by the developing blade 23 is called a regulating nip portion. In the regulating nip portion, the dielectric portions of the developing roller 22 are also charged. In Embodiment 1, the width W (contact width) of the regulating nip portion is about 130 μm, and is measured by the following method. The regulating nip portion corresponds to the contact portion that is formed between the regulating member and the developer bearing member.

Measurement of Width W of Regulating Nip Portion

To measure the width of the regulating nip portion, a region of the developing blade 23 contacting with the developing roller 22 is marked with an oil based ink, and after the marking dries, the developing roller 22 is contacted, and about 100 sheets are printed. Then the surface of the developing blade 23 is observed using VK-X100 (manufactured by Keyence).

The regulating nip portion of the developing blade 23 rotates in a state of the developing roller 22 pressing toner, hence the ink of the marking is stripped, and lines of the rubbed marks are generated in the developing blade 23. The width of the regulating nip portion is calculated based on the width of the rubbed marks.

Function of Gradient Force

Figure 1B:
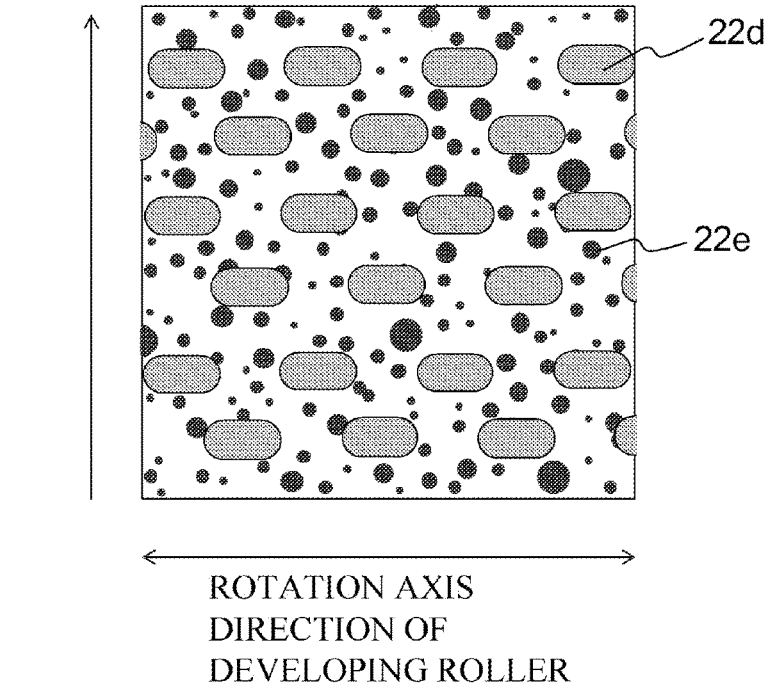

As illustrated in FIG. 1B, the dielectric portions 22*d* and the conductive portion 22*e* (the base layer 22*b* and the metal core 22*a* are conducted) are mixed on the surface of the developing roller 22. The dielectric portions 22*d* on the developing roller 22 are charged by the developing blade 23 (regulating member) rubbing the surface of the developing roller 22 directly or via toner. Then electric fields are generated in the charged dielectric portions 22*d*. A micro-closed electric field E is generated in a portion where the dielectric portion 22*d* and the conductive portion 22*e* are adjacent to each other, and many micro-closed electric fields E are formed on the entire developing roller 22.

Figure 4:
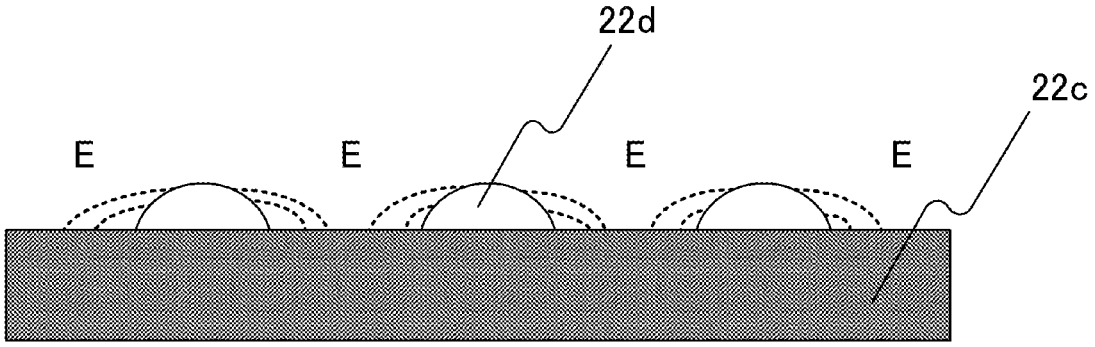
FIG. 4 is a diagram depicting micro-closed electric fields that act on the developing roller according to Embodiment 1.

For example, if the dielectric portions 22*d* are charged by the developing blade 23 rubbing the developing roller 22 via toner, the micro-closed electric fields E are formed so as to extend from each dielectric portion 22*d* to the conductive portion 22*e* in an arc shape, as illustrated in FIG. 4. As a result, toner in the developing chamber 24*a*, of which charge amount is unstable (no charge or low charge), is transported into the micro-closed electric fields E on the developing roller 22. The toner transported into the micro-closed electric fields E receives electrostatic force generated by the electric fields. or by the later mentioned gradient force that is generated by the micro-closed electric fields E in the case where the developer is not charged, and is attracted to and borne on the surface of the developing roller 22.

Figure 5A:
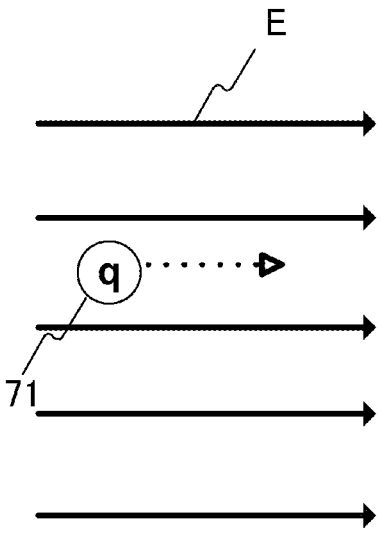
FIG. 5A and FIG. 5B are diagrams depicting a gradient force according to Embodiment 1.
Figure 5B:
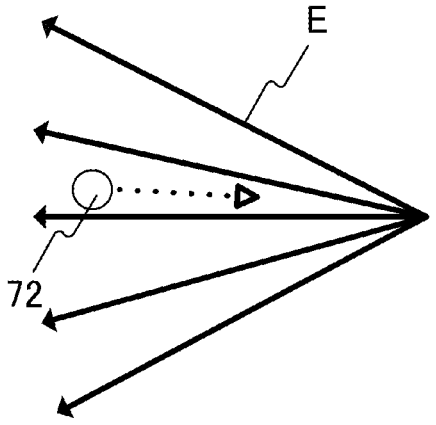

Here the gradient force will be described with reference to FIGS. 5A and 5B. FIG. 5A and FIG. 5B are schematic diagrams depicting the motion of a dielectric particle (developer particle) in the electric field. As illustrated in FIG. 5A, when a charged dielectric particle (toner particle) 71 is in an electric field provided from the outside, the dielectric particle 71 receives an electrostatic force in the same direction or in the opposite direction of the direction of the electric field, depending on the polarity (positive or negative) of the charge. In the case where a nonuniform electric field, in which magnitude is different depending on the position, is generated, as illustrated in FIG. 5B, an uncharged dielectric particle (toner particle) 72 in the nonuniform electric field receives a force directed to a region having a strong electric field (direction to the right in FIG. 5B), even if the dielectric particle is not charged. This force is called the gradient force (Ueda, et al, "Basics of Static Electricity", p. 15, Asakura Publishing, 1971).

Toner Charging Function

The toner borne on the developing roller 22 by the gradient force is regulated to a predetermined thickness by the developing blade 23. Further, by the developing blade 23 rubbing the surface of the developing roller 22 via the toner, the toner is charged to have a predetermined charge amount required for development, at a polarity depending on where the materials of the developing roller 22 and the developing blade 23 are located in the triboelectric series.

Figure 6:
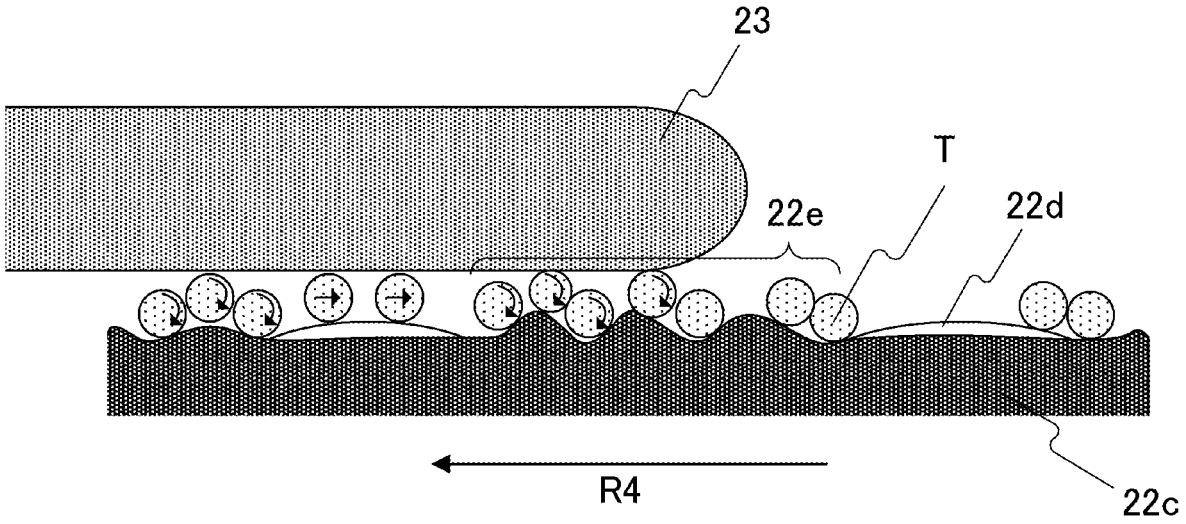
FIG. 6 is a diagram depicting a toner charge providing function according to Embodiment 1.

As illustrated in FIG. 6, the developing roller 22 is configured such that the surface roughness of the dielectric portion 22*d* and the surface roughness of the conductive portion 22*e* are different on the surface thereof. When the developing roller 22 rubs with the developing blade 23 via the toner, the toner attached to the dielectric portion 22*d* side is scraped by the regulating force of the developing blade 23, or is moved to the conductive portion 22*e* on the downstream side of the developing roller 22 in the rotating direction. The toner attached to the conductive portion 22*e* receives force to be transported from the surface of the conductive portion 22*e* in the moving direction of the developing roller 22. Further, this toner receives force, by rubbing with the developing blade 23, in the opposite direction of the rotating direction of the developing roller 22. As a result, the toner rolls and is charged by triboelectric charging, which is facilitated by the rubbing due to the rolling motion. Because of this, multilayers of toner having an attachment amount and a charging amount required for development can be stably borne on the developing roller 22. In other words, in order to feed and charge toner stably, it is preferable that the dielectric portion 22*d* and the conductive portion 22*e* alternately exist in the rotating direction of the developing roller 22, as illustrated in FIG. 6. Further, in order to feed and charge toner stably in the rotation axis direction of the developing roller 22, the average dielectric portion width Sx in the rotation axis direction of the developing roller 22 is designed to be larger than the average dielectric portion width Sy in the rotating direction of the developing roller 22. Thereby a region, where the dielectric portion 22*d* and the conductive portion 22*e* alternately exist in the rotating direction of the developing roller 22, can be stably formed in the rotation axis direction of the developing roller 22. As a result, the toner coat layer can be stably formed in the rotation axis direction of the developing roller 22.

Description of Functional Effects

The functional effects of Embodiment 1 on the solid black followability failure and fogging, in the case where deterioration or moisture absorption occurred to the developer, will be described next using comparative examples. An overview of the comparative examples follows.

Comparative Example 1

Surface roughening processing of conducive portion of developing roller: Yes

Dielectric portions of developing roller: No

Figure 7A:
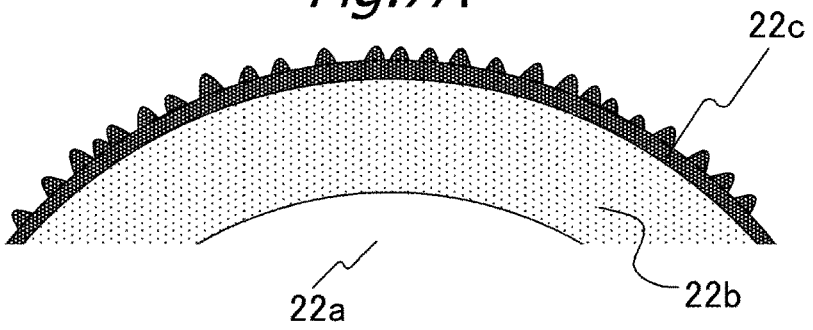
FIG. 7A to FIG. 7D are diagrams depicting developing rollers of Comparative Examples 1 to 4 described in Embodiment 1.

FIG. 7A is a cross-sectional view of the developing roller 22 according to Comparative Example 1. The difference from Embodiment 1 is that the dielectric portions 22*d* are not formed.

Comparative Example 2

Surface roughening processing of conducive portion of developing roller: Yes

Figure 7B:
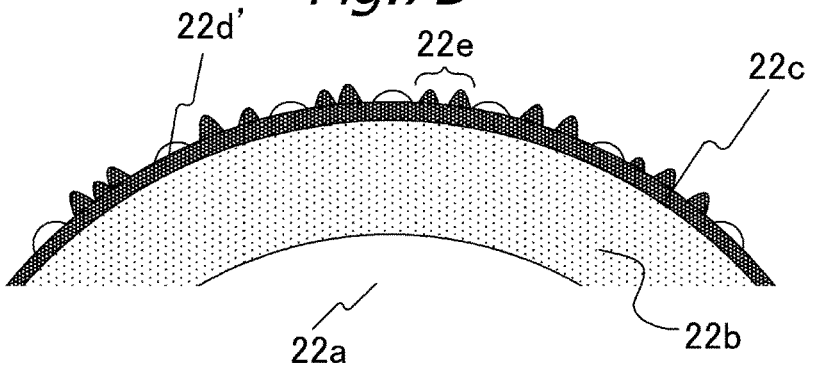

Dielectric portions of developing roller: Yes, polarity is opposite of normal charging polarity of developer Average dielectric portion width Sy=60 μm FIG. 7B is a cross-sectional view of the developing roller 22 according to Comparative Example 2. The difference from Embodiment 1 is that the dielectric portions 22*d*' are formed using a coating material, of which polarity is opposite of the normal charging polarity of the toner, for the material of the dielectric portions.

Comparative Example 3

Surface roughening processing of conducive portion of developing roller: No

Figure 7C:
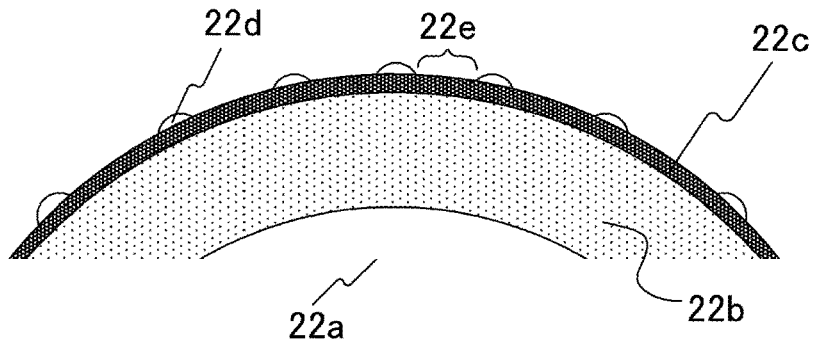

Dielectric portions of developing roller: Yes, polarity is the same as normal charging polarity of developer Average dielectric portion width Sy=60 μm FIG. 7C is a cross-sectional view of the developing roller 22 according to the Comparative Example 3. The difference from Embodiment 1 is that the surface layer of the conductive portion 22*e* does not contain the resin particles. In other words, the surface roughness of the dielectric portions 22*d* and the surface roughness of the conductive portion 22*e* are similar.

Comparative Example 4

Surface roughening processing of conducive portion of developing roller: Yes

Figure 7D:
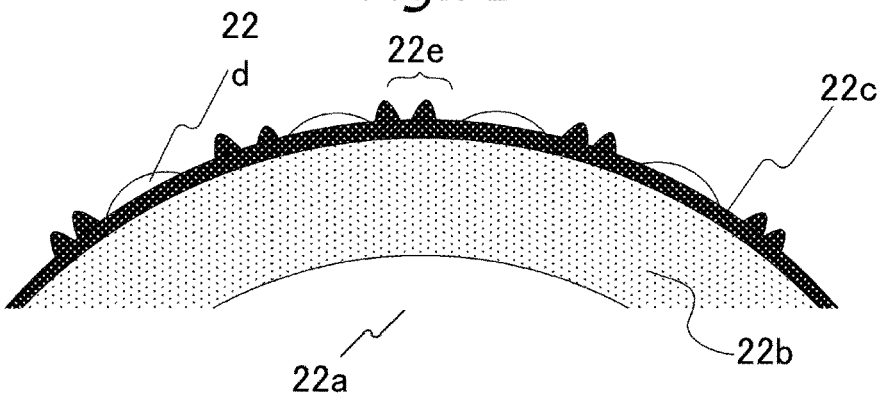

Dielectric portions of developing roller: Yes, polarity is the same as normal charging polarity of developer Average dielectric portion width=140 μm FIG. 7D is a cross-sectional view of the developing roller 22 according to Comparative Example 4. The difference from Embodiment 1 is that the average dielectric portion width Sy of the dielectric portions 22*d* is larger than the average dielectric portion width of Embodiment 1, and is larger than the width of the regulating nip portion N.

Comparison Results

Image evaluation tests were performed for the developing apparatuses of Embodiment 1, Comparative Example 1, and Comparative Example 2, using the image forming apparatus 100 in FIG. 2, specifically MF 726Cdw (manufactured by Canon). In concrete terms, the image evaluation tests were performed: in the case where the developing apparatus is new ("New") before passing paper (0 prints) in a high temperature high humidity environment (temperature: 30° C., humidity 80%); and in the case where 5000 sheets were passed ("Used"), to evaluate the images. A solid black image was used for the solid black followability, and a solid white image was used for fogging. Table 4 is the test result of the image evaluation.

TABLE 4

| | Solid black followability | | Fogging | | Density nonuniformity in half tone region | |
|---|---|---|---|---|---|---|
| | New | Used | New | Used | New | Used |
| Embodiment 1 | A | A | A | A | A | A |
| Comparative Example 1 | A | B | A | A | A | A |
| Comparative Example 2 | A | A | A | B | A | B |
| Comparative Example 3 | A | A | A | B | A | B |
| Comparative Example 4 | A | A | A | A | A | B |

The evaluation results on solid black followability, fogging and density nonuniformity in a half tone region for "New" and "Used", in the case of using the developing apparatuses of Embodiment 1 and each comparative example, will be described.

Evaluation Standard for Solid Black Followability

To evaluate solid black followability, a solid black image is outputted by the image forming apparatus 100, and the result is visually determined based on the following standard.

A: blank dots (solid black followability failure) not generated

B: blank dots (solid black followability failure) are generated

Evaluation Standard for Fogging

To evaluate fogging, paper with a solid white image outputted by the image forming apparatus 100 and paper outputted without attaching toner on the transfer material by masking the transfer material (reference paper) are used. Then reflectance of the outputted paper with the solid white image and the reflectance of the reference paper are measured using a reflectance meter, and the difference of these reflectance values is regarded as the index value which indicates fogging.

A: the difference value is less than 3.0

B: the difference value is at least 3.0

Evaluation Standard for Density Nonuniformity in Half Tone Region

To evaluate density nonuniformity in a half tone region, density nonuniformity is evaluated when a half tone image, of which density is 25%, is outputted. For example, an image is loaded in the 1200 dpi mode using an optical scanner (product name: CS9000F Mark II, manufactured by Canon). Then using this optical scanner, blur processing is performed with a σ=100 μm Gaussian filter, and the density width ratio at this time (the ratio of the maximum density value and the minimum density value with respect to the center density value) is evaluated based on the following standard.

A: density width ratio is less than 30%

B: density width ratio as least 30%

Effect of Embodiment 1 on Solid Black Followability

In Comparative Example 1, a solid black followability failure was generated in the case of "Used". In Embodiment 1, however, the generation of solid black followability failure was not confirmed for "New" and "Used". The reason why followability failure was generated in Comparative Example 1 is probably as follows. The developing roller 22 according to Comparative Example 1 is configured without dielectric portions 22*d*, hence the above mentioned gradient force is not applied to the toner. When the product is new, the toner is borne on the developing roller 22 by the image force since the toner charge amount required for development is sufficient, hence a solid black followability failure is not generated. However in the case where the product is used for a period of time (toner deterioration advances), as in the case of "Used" in a high humidity environment, low charged and non-charged toner are not borne on the developing roller 22 unless the gradient force is applied to the toner, and as a result, a solid black followability failure is generated.

Effect of Embodiment 1 on Fogging

In Comparative Example 2 and 3, the generation of fogging was observed in the case of "Used". In Embodiment 1, on the other hand, the generation of fogging was not observed for both "New" and "Used". The reason why fogging was generated in Comparative Example 2 is probably as follows. The developing roller 22 according to Comparative Example 2 is configured such that the polarity of dielectric portions 22*d* is opposite of the polarity of toner, hence when the toner is borne on the developing roller 22 by the gradient force, the toner is mainly adsorbed on the surface of the dielectric portions 22*d*. In this case, the force that is applied to the toner is the gradient force and an electrostatic force which is generated by the polarity difference between the dielectric portions 22*d* and the toner, and these forces are applied toward the developing roller 22 side. Therefore when the toner is rubbed by the regulating portion, the adsorbing force to the developing roller 22 by the gradient force and the electrostatic force become larger than the force that is applied in a direction opposite the rotating direction of the developing roller 22 generated by the rubbing with the developing blade 23. As a result, the charging function by the rolling motion of the toner becomes insufficient, and more conspicuous fogging is generated.

The reason why the fogging was generated in Comparative Example 3 is probably as follows. The developing roller 22 according to Comparative Example 3 is configured such that the surface layer of the conductive portion 22*e* does not contain the resin particles. Therefore when the toner borne on the developing roller 22, transported by the gradient force, is rubbed by the regulating unit, the toner cannot receive the force to be transported in the rotating direction of the developing roller 22 due to the surface of the conductive portion 22*e,* which has been roughened. As a result, the charging function by the rolling motion of the toner becomes insufficient, and more conspicuous fogging is generated.

In the developing roller 22 according to the Comparative Example 1, toner, that was transported to the regulating unit and passed the regulating portion, is sufficiently charged by the conductive portion 22*e,* hence the generation of fogging was not observed.

Effect of Embodiment 1 on Density Nonuniformity in Half Tone Region

In the case of using the developing rollers 22 of Comparative Example 2, Comparative Example 3 and Comparative Example 4, the generation of density nonuniformity in the half tone region was observed when the product is "Used". In Embodiment 1, however, the generation of density nonuniformity in the half tone region was not observed for both "New" and "Used" products. In Embodiment 1, the average dielectric portion width Sy is 60 μm, which is less than ½ of the width 130 μm of the regulating nip portion N.

Figure 8A:
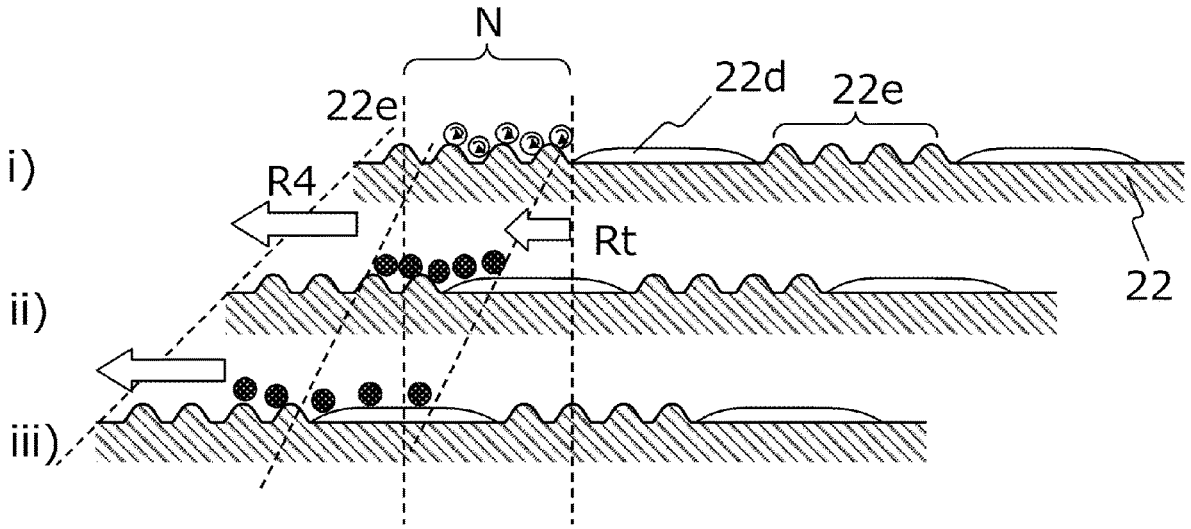
FIG. 8A and FIG. 8B are diagrams depicting charging of dielectric portions on the developing roller of Comparative Example 4 described in Embodiment 1.
Figure 8B:
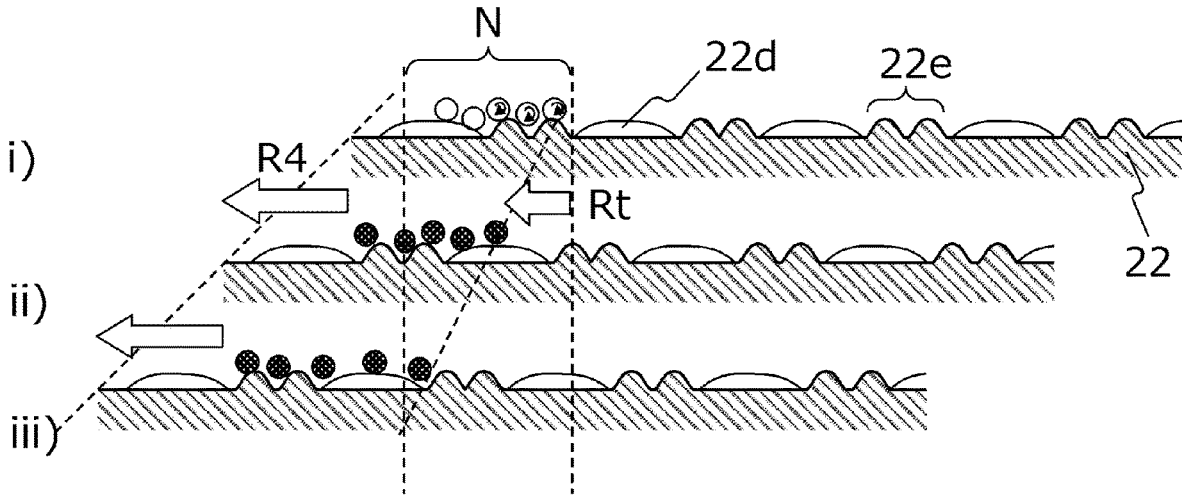

The state of toner passing through the regulating nip portion N of Embodiment 1 and the charging function for the dielectric portions 22*d,* which probably causes density nonuniformity in the half tone region, will be described with reference to FIG. 8A and FIG. 8B. FIG. 8A illustrates a state of the developing roller 22 passing through the regulating nip portion N over time ((i) to iii) in FIG. 8A), in the case where the average dielectric portion width Sy is smaller than the width of the regulating nip portion N.

The toner is transported by the developing roller 22 and passes through the regulating nip portion N. Here the toner receives the regulating force of the developing blade 23, hence the toner moves together in the Rt direction at a speed that is relatively slower than the rotating speed of the developing roller 22, while rolling in the rotating direction R4 of the developing roller 22.

Figure 10:
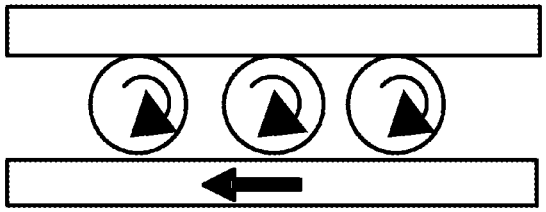
FIG. 10 is a diagram depicting a rolling model of a developer regulating unit according to Embodiment 1.
Figure 10:
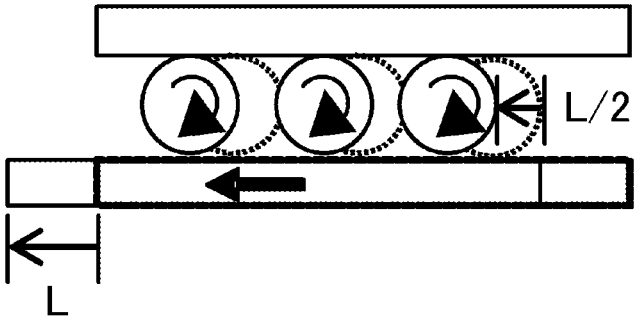

Transport of the toner in the regulation portion can be examined using a simple roller model (a model in which balls are sandwiched by two plates), as illustrated in FIG. 10. If it is assumed that the thickness of the coating of the toner (balls) from the developing roller 22 (lower moving plate) to the developing blade 23 (upper plate) is a thickness of one particle, then the moving distance of the toner is shorter than the moving distance of the developing roller 22.

For example, if it is assumed that the toner contacts with the developing blade 23 or the developing roller 22 with certainty, then the moving distance of the toner, with respect to the developing blade 23 in the rotating direction of the developing roller 22, is L/2, that is, half of the moving distance L of the developing roller 22.

In Embodiment 1, the coating amount of the toner on the developing roller 22 is about one layer (one particle) to two layers (two particles). Therefore the toner charged by the conductive portion 22*e* (hatched in FIG. 8A) is transported to the dielectric portions 22*d* on the downstream side of the developing roller 22 in the rotating direction. In the dielectric portions 22*d,* the toner charging function is insufficient, as mentioned above, but the dielectric portions 22*d* themselves can be charged by the toner rubbing with the dielectric portions 22*d.*

The charging function for the dielectric portions 22*d* is performed by the rubbing by the developer feeding unit and rubbing by the toner. In the "Used" state where toner has deteriorated, the contribution of the charging function of the developer feeding unit via the toner decreases. Therefore it is critical to charge the dielectric portion 22*d* by the toner charged by the conductive portion 22*e* in the regulating unit.

In Embodiment 1, the average dielectric portion width Sy of the dielectric portions 22*d* in the rotating direction of the developing roller 22 is smaller than the width of the regulating nip portion N. Therefore the charged toner can rub and charge the entire range of the average dielectric portion width of the dielectric portions 22*d,* while passing through the regulating nip portion N. Thereby the charge amount of the dielectric portions 22*d* is maintained throughout the longer direction of the dielectric portions 22*d* by rubbing and charging. As a result, even under a high humidity environment, the micro-closed electric fields are formed, and the toner is borne and transported in the developing chamber in the state of maintaining the gradient force, whereby the coating is stably formed in the regulating portion.

As described above, in Embodiment 1, the dielectric portions 22*d* are sufficiently charged to the charge amount required for development, by the toner charged in the regulating portion, hence even if high density printing is continued, the density in the half tone region can be maintained to be uniform.

In the case of Comparative Example 4, on the other hand, the average dielectric portion width Sy is 140 μm, and the width of the regulating nip portion N is 130 μm. Here a state of the dielectric portions 22*d* that are charged when the average dielectric portion width Sy is longer than ½ of the width of the regulating nip portion N will be described with reference to FIG. 8B.

In Comparative Example 4, the toner is transported by the developing roller 22 and passes through the regulating nip portion N, just like the case of Embodiment 1. Here the toner receives the regulating force of the developing blade 23, hence the toner moves together in the Rt direction at a speed that is relatively slower than the rotating speed of the developing roller 22, while rolling in the rotating direction R4 of the developing roller 22. Therefore the toner charged by the conductive portion 22*e* is transported to the dielectric portions 22*d* on the downstream side of the developing roller 22 in the rotating direction, and charge the dielectric portions 22*d* themselves by rubbing with the dielectric portions 22*d.*

However in the rotating direction of the developing roller 22, the width of the dielectric portion 22*d* is larger than the width of the regulating nip portion N, hence the toner charged by the conductive portion 22*e* passes through the regulating nip portion N without rubbing the entire range of the average dielectric portion width of the dielectric portions 22*d.* Then the toner is transported at a speed similar to the rotating speed of the developing roller 22 without receiving the regulating force from the developing blade 23. Therefore rubbing with the toner is not performed in the dielectric portions 22*d* on the downstream side of the developing roller 22 in the rotating direction, and the charge amount of the dielectric portions 22*d* differs between the upstream side and the downstream side of the developing roller 22 in the rotating direction. Further, the gradient force to hold and transport toner is also different between a dielectric portion 22*d* on the upstream side and that on the downstream side of the developing roller 22 in the rotating direction. As a result, the coating amount of the toner on the developing roller 22 becomes nonuniform, and the density nonuniformity is generated particularly in a half tone region where density easily changes.

The developing roller 22 in Comparative Example 1 does not have the dielectric portions 22*d*. Therefore the density nonuniformity in the half tone region, caused by the change in the charge amount of the dielectric portions 22*d*, was not generated. The developing roller 22 in Comparative Example 2 includes dielectric portions 22*d*' of which polarity is opposite the toner. Therefore the contribution of rubbing of the dielectric portions 22*d*' and the toner in the regulating portion, to charge the dielectric portions 22*d*', is small because electrostatic attraction is applied, and the charging of the dielectric portions 22*d*' by the developer feeding member 26 is dominant. Hence in a state where toner deteriorates in a "used" product, charging of the dielectric portions 22*d*' is easily influenced by the charging function of the rubbing of the developer feeding member 26, and as a result, the charge amount of the dielectric portions 22*d*' drops, and the density nonuniformity is generated in the half tone region. Further, in the case of the developing roller 22 in Comparative Example 3, the charging function for the toner in the regulating portion becomes insufficient for the same reason as the case of generating fogging. This probably results in a drop in the charge amount from the charged toner to the dielectric portions 22*d*, and generates the density nonuniformity in the half tone region.

As mentioned above, it is preferable that the average dielectric portion width Sy is ½ or less the width of the regulating nip portion N, which is a moving distance of the toner, in the case where the coating thickness of the toner is assumed to be one layer (one particle).

As described above, according to Embodiment 1, such image problems as fogging and density nonuniformity in the half tone region can be suppressed while suppressing the generation of a solid black image followability failure, even if deterioration or moisture absorption of the developer is generated.

Embodiment 2

Embodiment 2 of the present invention will be described next. Since the basic configuration is the same as Embodiment 1, only the characteristics of Embodiment 2 will be described. In Embodiment 2, a composing element the same as Embodiment 1 is denoted with the same reference sign, and redundant description thereof is omitted.

Figure 9:
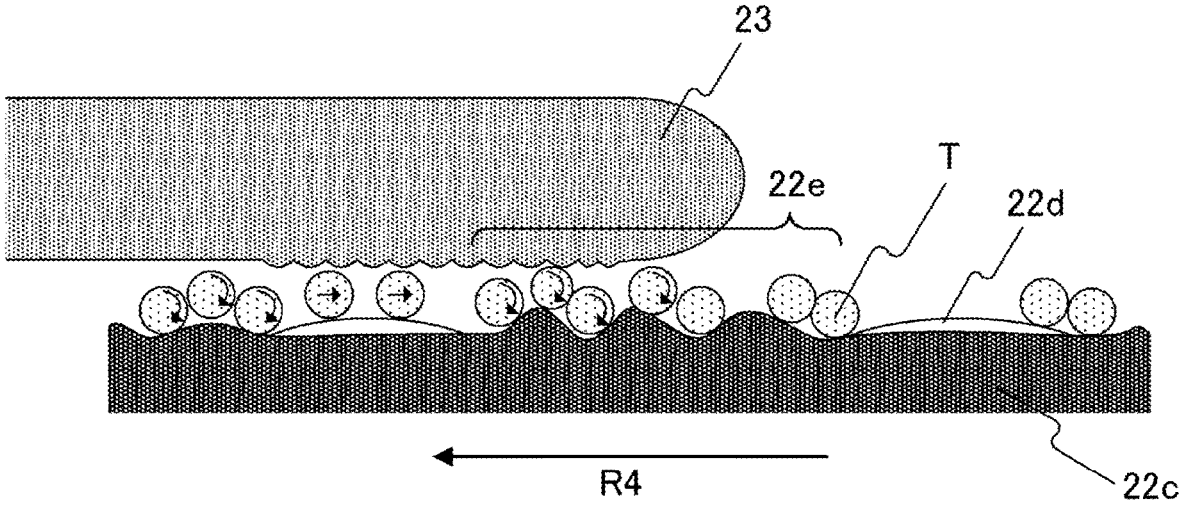
FIG. 9 is a diagram depicting a toner charge providing function according to Embodiment 2.

In the configuration described in Embodiment 1, the rolling motion of the toner in the regulating portion is promoted based on the relationship between the surface roughness of the dielectric portions 22*d* and the surface roughness of the conductive portion 22*e* in the developing roller 22, so as to suppress black solid followability failure and fogging. In the configuration in Embodiment 2, as illustrated in FIG. 9, it is configured that the surface roughness (third surface roughness) of the surface of the developing blade 23 facing the developing roller 22 is smaller than the surface roughness of the conductive portion 22*e*, and is larger than the surface roughness of the dielectric portion 22*d*. The surface roughness of the developing blade 23 is measured using the above mentioned method of measuring the surface roughness of the dielectric portions 22*d* and the conductive portion 22*e*.

In Embodiment 2, the surface roughness of the developing blade 23 is larger than the surface roughness of the dielectric portions 22*d*. Therefore when the developing roller 22 is rubbed by the developing blade 23 via the toner, the toner attached to the dielectric portions 22*d* is scraped by the surface of the developing blade 23, whereby the toner is moved to the conductive portion 22*e* on the downstream side of the developing roller 22 in the rotating direction of the developing roller 22. Further, the surface roughness of the conductive portion 22*e* is larger than the surface roughness of the developing blade 23. Therefore the toner attached to the conductive portion 22*e* is transported by the surface of the conductive portion 22*e* in the rotating direction of the developing roller 22, and receives force in a direction opposite of the rotating direction of the developing roller 22 due to the rubbing with the developing blade 23. As a result, triboelectric charging, caused by rubbing due to the rolling motion of the toner, becomes active, and charging of toner can be promoted even more than the developing apparatus of Embodiment 1.

Figure 11A:
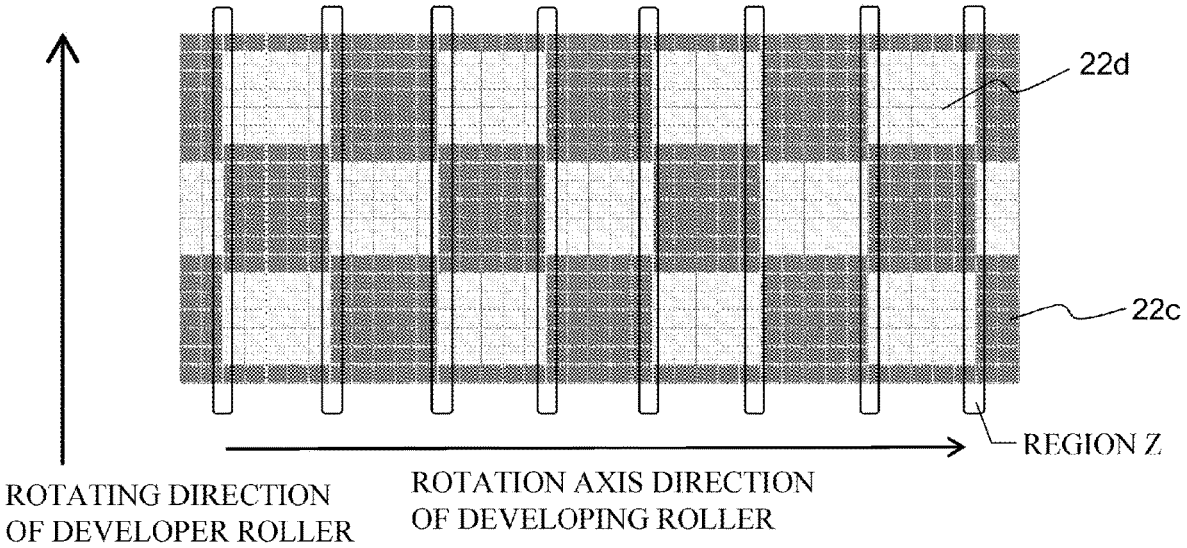
FIG. 11A and FIG. 11B are diagrams depicting the arrangement functions of the dielectric portions and the conductive portion according to Embodiment 1.
Figure 11B:
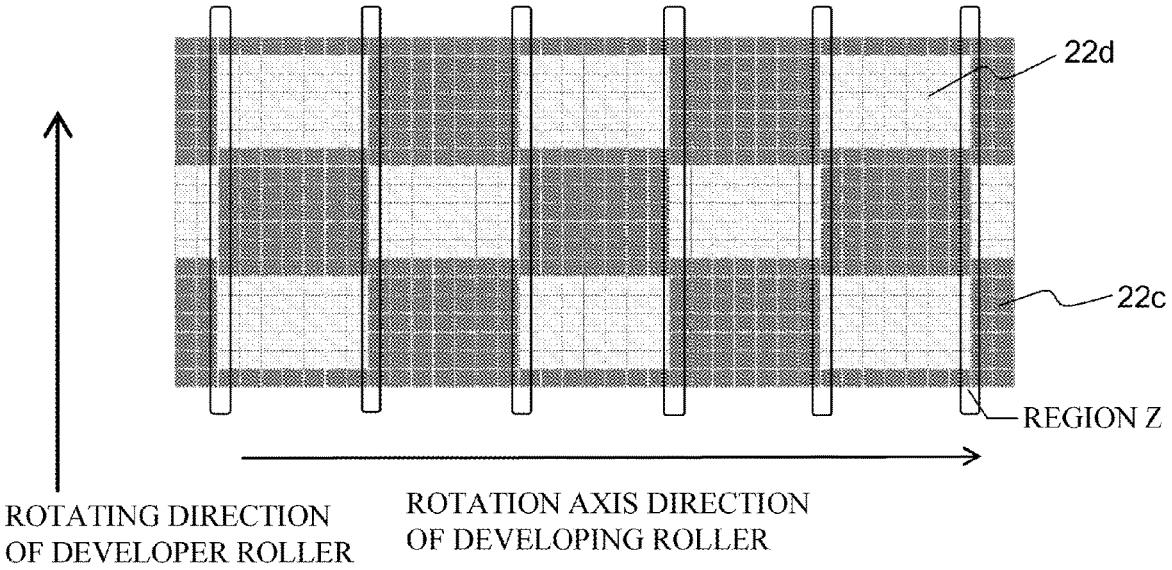

The relationship between the average dielectric portion width of the developing roller 22 and the stability of the coating layer of the toner will be described with reference to FIG. 11A and FIG. 11B. FIG. 11A is a schematic arrangement of the dielectric portions 22*d* where Sx/Sy=1.0, and the conductive portion 22*e*. The region indicated by "region Z" is a region which does not include a portion where the dielectric portions 22*d* are overlapped on the downstream side of the developing roller 22 in the rotating direction. In such a region, the toner feed amount may become insufficient. FIG. 11B, on the other hand, is a schematic arrangement of the dielectric portions 22*d* of which Sx/Sy=1.4, and the conductive portion 22*e*. As illustrated in FIG. 11B, the number of regions Z decreases as Sx becomes larger than Sy.

As a result of an in depth study, the present inventors discovered that the solid black image can effectively become uniform when Sx/Sy is 1.4 or more. Therefore in the present invention, it is preferable that Sx/Sy is 1.4 or more.

Further, it is preferable that the average dielectric portion width Sy of the developing roller 22 in the rotating direction is larger than the average particle diameter D of the toner. The average particle diameter of the toner according to Embodiment 1 is 6.5 for example. In the case where the average particle diameter of the toner is 6.5 μm, Sy=13 μm if Sy/D=2.0. To measure the average particle diameter of the toner in Embodiment 1, a liquid module is installed in the LS-230 type laser diffraction type particle size distribution measurement apparatus manufactured by Backman Coulter, and the average particle diameter was calculated by the acquired particle distribution on a volume basis in the 0.04 to 2000 μm particle diameter measurement range.

Figure 12A:
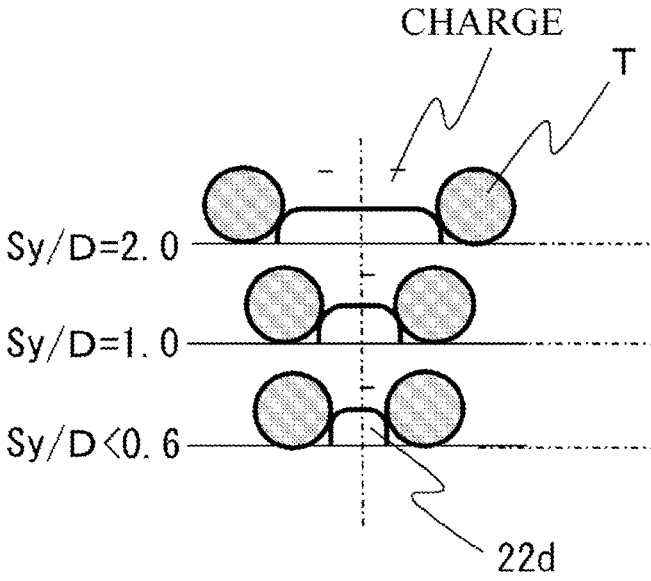
FIG. 12A and FIG. 12B are diagrams depicting the relationship between the value of Sy and the toner particle size according to Embodiment 1.
Figure 12B:
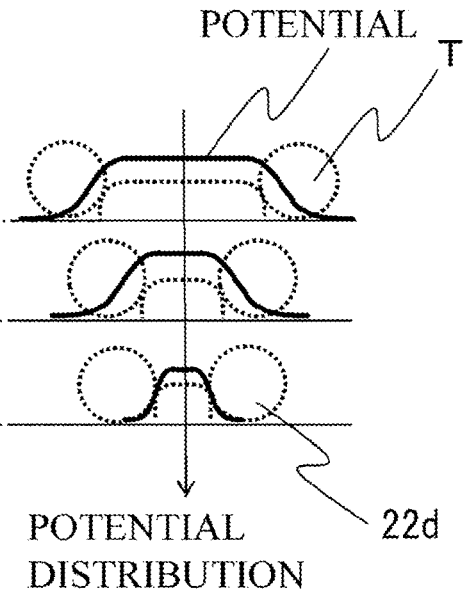

FIG. 12A is a schematic diagram depicting a relationship of the dielectric portions 22*d* and the toner particles T when Sy/D=2.0, Sy/D=1.0 and Sy/D=0.6. When the average particle diameter of the toner is 6.5 μm, Sy=13 μm if Sy/D=2.0. FIG. 12A also indicates the arrangement of charges on the dielectric portions 22*d* when the surface charge density is uniform. FIG. 12B indicates the potential distribution that is formed when the dielectric portions 22*d*, the toner particles T and the charges are disposed, as illustrated in FIG. 12A. If Sy/D=2.0 or 1.0, the potential change (gradient force) generated in a region where the toner particles T exist is large. On the other hand, if Sy/D=0.6, the potential change generated in a region where the toner particles T exist is small, hence the toner feed amount becomes insufficient.

Hence in order to perform a stable toner transfer by forming a stable potential, it is preferable that Sy is at least the average particle diameter of the toner, that is, Sy/D is 1.0 or more.

Description of Functional Effects

The functional effects of Embodiment 1 on the solid black followability failure, fogging and solid black image nonuniformity, in the case where deterioration or moisture absorption occurred to the developer, will be described next using comparative examples. Brief descriptions of the comparative examples are given below.

Comparative Example 5

Surface roughening processing of conductive portion of developing roller: Yes

Dielectric portions of developing roller: No

Figure 13A:
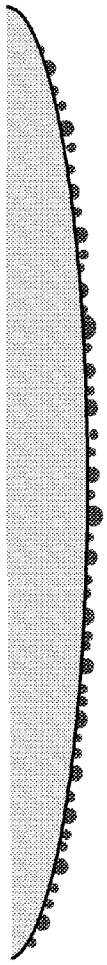
FIG. 13A and FIG. 13B are diagrams depicting a developing roller according to Comparative Example 5.
Figure 13B:
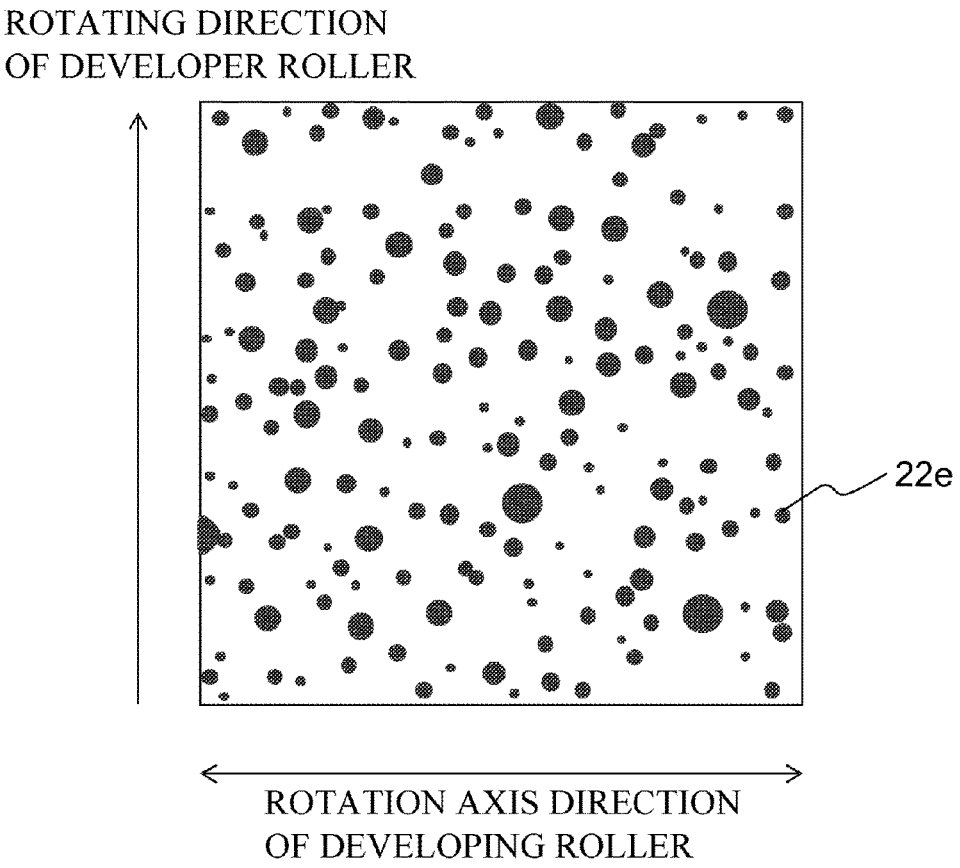

FIG. 13A and FIG. 13B are diagrams depicting the developing roller 22 according to Comparative Example 5. FIG. 13A and FIG. 13B correspond to FIG. 1A and FIG. 1B respectively. A difference from Embodiment 1 is that the dielectric portions 22*d* are not included.

Comparative Example 6

Surface roughening processing of conductive portion of developing roller: No

Dielectric portions of developing roller: Yes

Figure 14A:
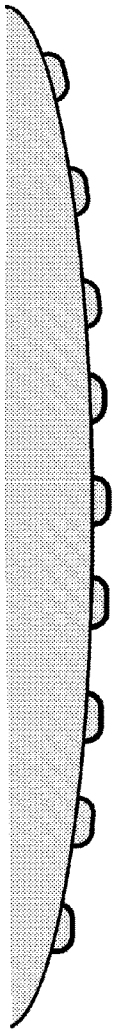
FIG. 14A and FIG. 14B are diagrams depicting a developing roller according to Comparative Example 6.
Figure 14B:
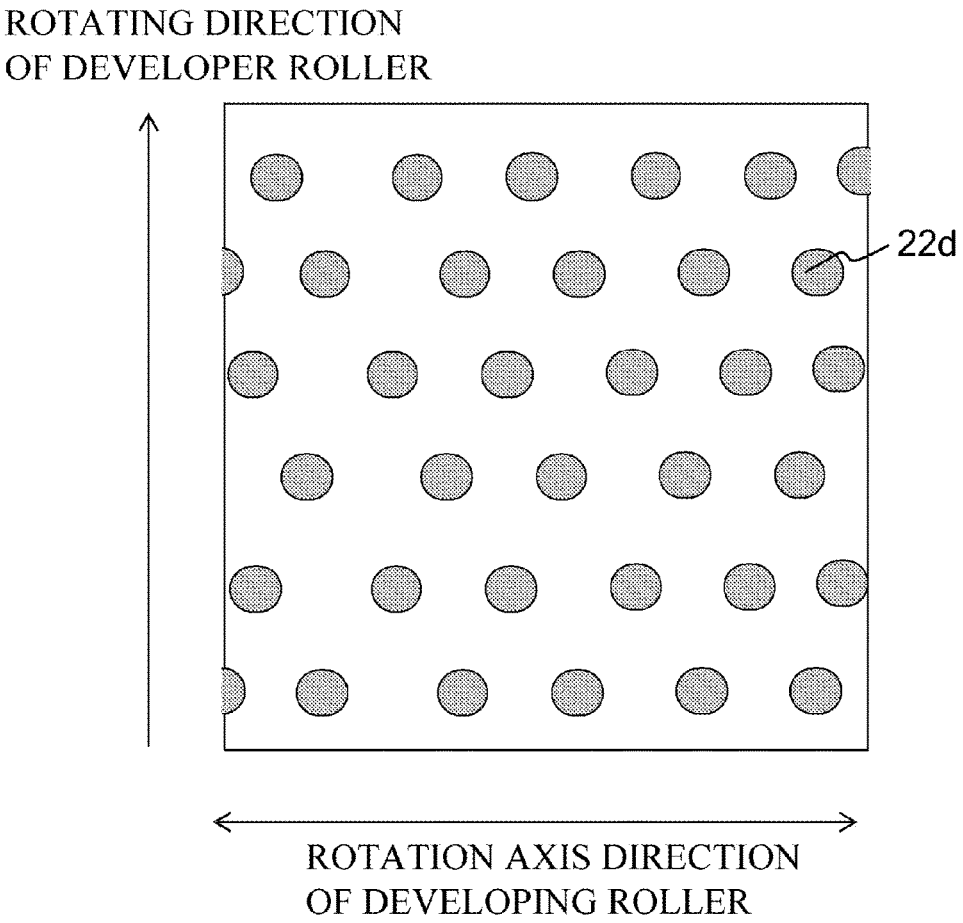

FIG. 14A and FIG. 14B are diagrams depicting the developing roller 22 according to Comparative Example 6. FIG. 14A and FIG. 14B correspond to FIG. 1A and FIG. 1B respectively. A difference from Embodiment 1 is that the surface layer of the conductive portion 22*e* does not include the resin particles. In other words, the surface roughness of the dielectric portions 22*d* and the surface roughness of the conductive portion 22*e* are similar.

In addition to the above Embodiment 1, the following Embodiments 3 and 4 of the present invention will also be included in a comparison.

Embodiment 3

Dielectric portions of the developing roller: extended in the rotation axis direction of the developing roller 22

Figure 15:
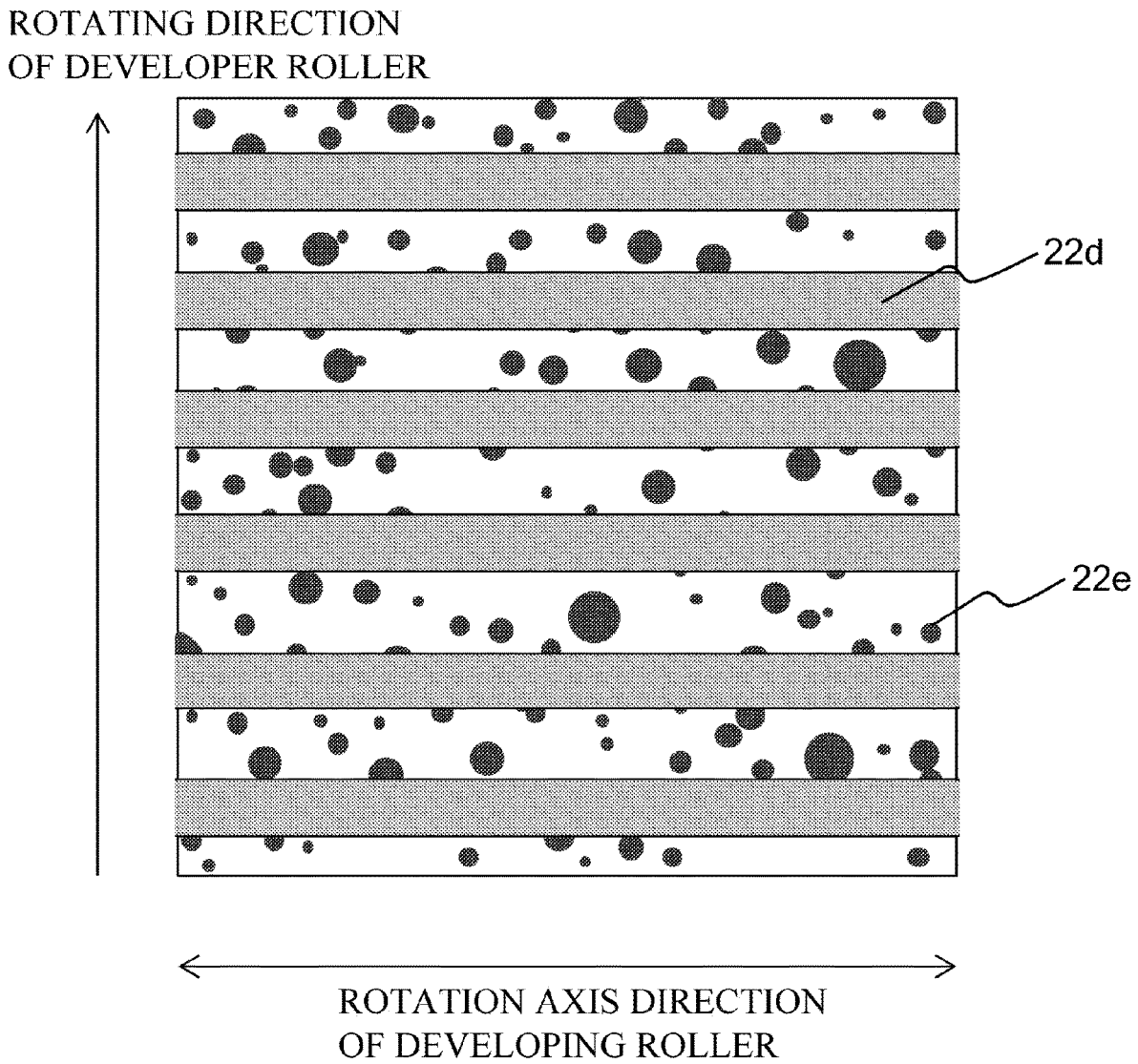
FIG. 15 is a diagram depicting a developing roller according to Embodiment 3.

FIG. 15 is a diagram depicting the developing roller 22 according to Embodiment 3. The difference from Embodiment 1 is that the dielectric portions 22*d* are formed as regions that extend in the rotation axis direction of the developing roller 22.

Embodiment 4

Embodiment 4 will be described next. The basic configuration and operation of the image forming apparatus 100 according to Embodiment 4 are the same as Embodiment 1. Therefore in the image forming apparatus 100 of Embodiment 4, a composing element the same as or corresponding to the function or configuration of the image forming apparatus 100 of Embodiment 1 is denoted with the same reference sign, and redundant description thereof is omitted.

In Embodiment 4, there are many sections (outer periphery sections) where a tangential line of the boundary line of a dielectric portion 22*d* with the conductive portion 22*e* continues for at least a predetermined width in the state of being inclined with respect to the rotation axis direction of the developing roller 22. Concrete examples of the predetermined width will be described later.

In other words, in Embodiment 4, the angle formed by the tangential line of the boundary line of the dielectric portion 22*d* with the conductive portion 22*e* and the line that is parallel with the rotation axis of the developing roller 22 (hereafter called the intersecting angle) is assumed to be θ. In this case, in one dielectric portion 22*d*, the section where the intersecting angle θ is an acute angle continues for at least a predetermined width. When the interacting angle θ is an acute angle, 0 (deg)<θ<90 (deg) or 0 (deg)>θ>−90 (deg) establishes.

Further, for the dielectric portions 22*d* in a 900 μm squared region on the surface of the developing roller 22, a section where the intersecting angle θ is an acute angle is converted into a width of the developing roller 22 in the rotation axis direction (hereafter called inclined section width). In Embodiment 4, a dielectric portion 22*d*, of which inclined section width is larger than 2 πD, exists in the above mentioned squared region (D is an average particle diameter of the toner). Among the sections of which the inclined section width is larger than 2 πD, if the number of sections of which the inclined section width is at least 50 μm is denoted by W1, and the number of sections of which inclined section width is less than 50 μm is denoted by W2, W1 is W2 or larger. Here it is assumed that the intersecting angle θ is positive if it is in the direction from the rotation axis direction of the developing roller 22 to the rotating direction of the developing roller 22, and is negative if it is in the direction that is opposite of the rotating direction of the developing roller 22.

Figure 16A:
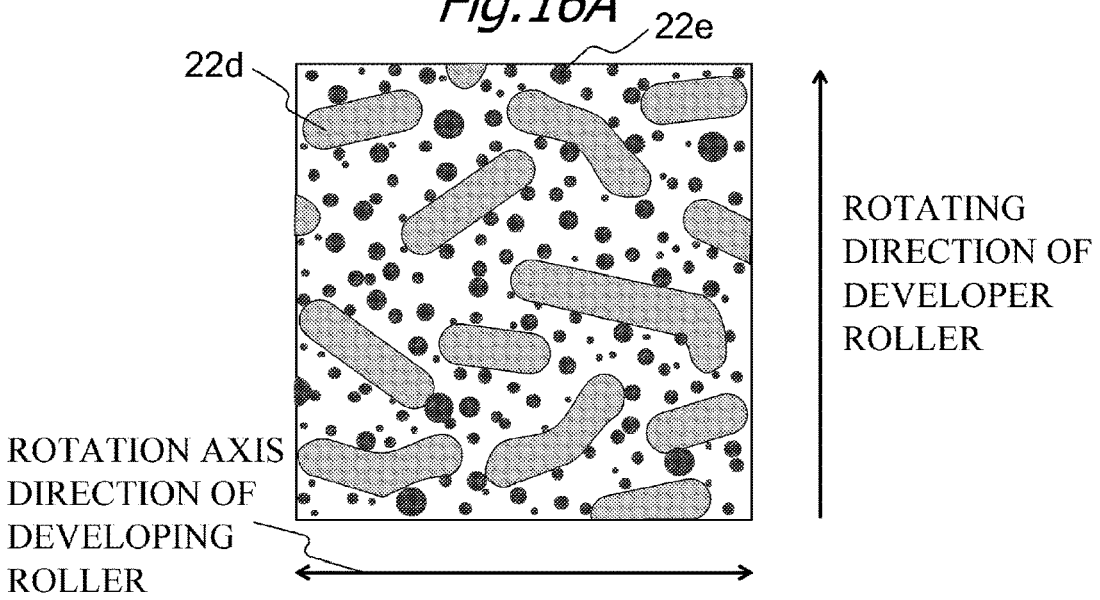
FIG. 16A to FIG. 16C are diagrams depicting a method of calculating the inclined section width according to Embodiment 4.
Figure 16B:
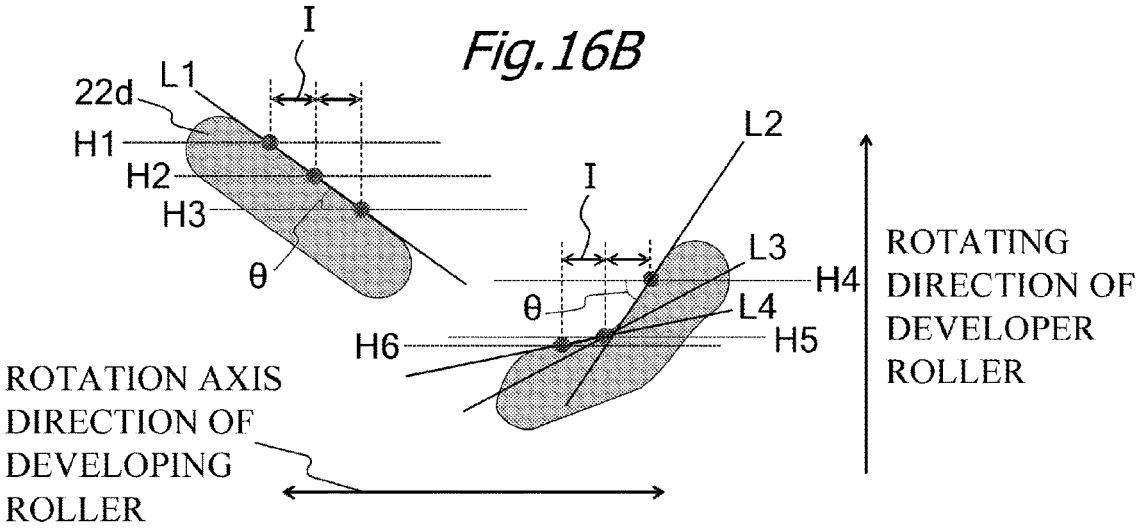
Figure 16C:
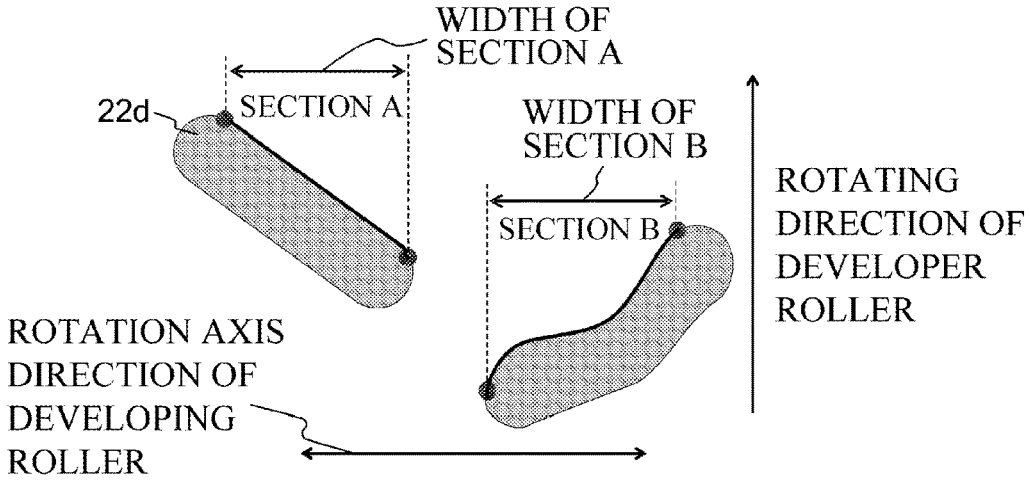

With reference to FIGS. 16A to 16C, the method of calculating the inclined section width of Embodiment 4 will be described. The method of calculating the inclined section width is not limited to the following method, but another measuring device and imaging processing methods may be used.

First an object lens, of which magnification is 10, is installed in the laser microscope (product name: VK-X100, manufactured by Keyence). Then the 1.5 mm×1.0 mm region on the surface of the developing roller 22 is two-dimensionally scanned by the confocal optical system of the laser, so as to acquire a high contrast image on the surface of the developing roller 22. In the acquired image, a 900 μm squared region, as illustrated in FIG. 16A, is set as the evaluation target. Within this squared region, the boundary line of each dielectric portion 22*d* with the conductive portion 22*e* is detected, and the intersecting angle θ is calculated based on the detected boundary line.

Then as illustrated in FIG. 16B, evaluation points are set on the boundary line of the dielectric portion 22*d* with the conductive portion 22*e* at a predetermined pitch I in the rotating direction of the developing roller 22, and the tangential line at each evaluation point (tangential lines L1 to L4 in FIG. 16B, for example) is determined. Then for each tangential line, the intersecting angle θ formed by the tangential line and the line that is parallel with the rotation axis of the developing roller 22, which passes through the evaluation point for which the tangential line was determined (lines H1 to H6 in FIG. 16B, for example), is calculated. In Embodiment 4, the intersecting angle is calculated assuming that the predetermined pitch I is a 0.01 mm pitch, for example.

Then based on the intersecting angle θ calculated for each evaluation point, the section where the intersecting angle θ is an acute angle, and the width of this section in the rotation axis direction of the developing roller 22 (inclined section width) are calculated. For example, in the example illustrated in FIG. 16C, the section where the intersecting angle θ is an acute angle is section A and section B. In Embodiment 4, when the inclined section width of the section where the intersecting angle θ is an acute angle is larger than 2 πD, this means that there is a section where one toner particle can roll for at least one rotation. Among the sections of which the inclined section width is larger than 2 πD, if the number of sections of which the inclined section width is at least 50 μm is denoted by W1, and the number of sections of which the inclined section width is less than 50 μm is denoted by W2, it is preferable that W1 is W2 or larger.

To calculate the inclined section width, one squared region mentioned above is set in each of 10 regions acquired by equally dividing the developing roller 22 into 10 in the longer direction (rotation axis direction) of the developing roller 22. In Embodiment 4, toner of which average particle diameter is 6.5 μm is used, hence when the inclined section width is larger than 2 πD, this means that the inclined section width is larger than 20 μm. For example, the number of sections W1 of which the inclined section width is at least 50 μm is 22, and the number of sections W2 of which inclined section width is less than 50 μm is 12, that is, W1 is larger than W2.

Hence in the regulating portion where the developing roller 22 contacts the developing blade 23, the toner borne and transported on the surface of the developing roller 22 is rubbed. As a result, when rolling on the surface of the developing roller 22, the toner moves in the rotation axis direction (longer direction) of the developing roller 22. In concrete terms, the movement of toner in the rotation axis direction (longer direction) of the developing roller 22 is promoted, because the sections which are inclined with respect to the rotation axis direction of the developing roller 22 exist at the boundary between the dielectric portions 22*d* and the conductive portion 22*e*.

The reason why there are many sections of which the inclined section width is at least 50 μm in the evaluation region is probably because of the following reason. It is believed that the spatial resolution that can be visually recognized is about 100 μm (about 50 μm to recognize dots). Therefore in a section of which the inclined section width is less than 50 μm, there is very little toner that is transported on the developing roller 22 in the rotation axis direction, and the above mentioned effect is difficult to be visually recognized, but in a section of which the inclined section width is 50 μm or more, the above mentioned effect can be visually recognized.

The dielectric portions 22*d* according to Embodiment 4 are formed on the surface of the surface layer 22*c* of the developing roller 22 by spraying the coating material to form the dielectric portions 22*d*. In concrete terms, the coating material is sprayed on the surface of the roller on which the surface layer 22*c* is formed, so that the coating amount becomes 0.040 g. Further, the coated film is heated at 140° C. for 80 minutes, so as to dry and cure the coated film. In Embodiment 4, the dielectric portions 22*d* are formed by the spray method, but the coating material is not limited to this, and may be a dispenser method or ink jet method. In this case, the types of materials and conditions of the delivery amount may be appropriately adjusted. In Embodiment 4, the average dielectric portion width Sx in the direction orthogonal to the rotating direction of the developing roller 22 is 64 μm, and the average dielectric portion width Sy in the rotating direction of the developing roller 22 is 45 μm, that is Sx/Sy=1.42.

Comparison Results

Image evaluation tests were performed for the developing apparatuses of Embodiments 1, 3, 4 and Comparative Examples 5 and 6, using the image forming apparatus 100 in FIG. 2, specifically MF726Cdw (manufactured by Canon). In concrete terms, the image evaluation tests were performed: in the case where the developing apparatus is "New" before passing paper (0 prints) in a high temperature high humidity environment (temperature: 30° C., humidity: 80%); and in the case where 5000 sheets were passed ("Used"). To evaluate the images, a solid black image was used for the solid black followability, and a solid white image was used for fogging. Table 5 is the test result of the image evaluation.

TABLE 5

| | Solid black followability | | Fogging | | Solid black image uniformity | |
|---|---|---|---|---|---|---|
| | New | Used | New | Used | New | Used |
| Embodiment 1 | A | A | A | A | AA | A |
| Comparative Example 5 | A | B | A | A | AA | B |
| Comparative Example 6 | A | A | A | B | AA | B |
| Embodiment 3 | A | A | A | A | AA | AA |
| Embodiment 4 | A | A | A | A | AA | AA |

Evaluation results on solid black followability, fogging and solid black image uniformity for "New" and "Used" will be described in the case of using the developing apparatuses of each embodiment and each comparative example.

Evaluation Standard for Solid Black Followability

To evaluate solid black followability, a solid black image is outputted by the image forming apparatus 100, and the result is visually determined based on the following standard.

A: Blank dots (solid black followability failure) not generated

B: blank dots (solid black followability failure) generated

Evaluation Standard for Fogging

To evaluate fogging, paper with a solid white image outputted by the image forming apparatus 100 and paper outputted without attaching toner on the transfer material by masking the transfer material (reference paper) are used. Then the reflectance of the outputted paper with the solid white image and the reflectance of the reference paper are measured using a reflectance meter, and the difference between these reflectance values is regarded as the index value which indicates fogging.

A: the difference value is less than 3.0

B: the difference value is at least 3.0

Evaluation Standard for Slid Black Image Uniformity

To evaluate the solid black image uniformity, a solid black image is outputted by the image forming apparatus 100, and the solid black image uniformity is visually determined based on the following standard.

AA: vertical lines of density nonuniformity not generated

A: several (e.g. 2 or 3) vertical lines of density nonuniformity generated

B: many (e.g. 4 or more) vertical linens of density nonuniformity generated

Effect of Embodiments 1, 3 and 4 on Solid Black Followability

In Comparative Example 5, a solid black followability failure was generated in the case of "Used". In Embodiments 1, 3 and 4, however, the generation of solid black followability failure was not confirmed for "New" and "Used". The reason why followability failure was generated in Comparative Example 5 is probably as follows. The developing roller 22 according to Comparative Example 5 is configured without dielectric portions 22*d*, hence the above mentioned gradient force is not applied to the toner. When the product is new, the toner is borne on the developing roller 22 by the image force since the toner charge amount required for development is sufficient, hence a solid black followability failure is not generated. However, in the case where the product is used for a period of time (toner deterioration advances), as in the case of "Used" in a high humidity environment, low charged and non-charged toner are not borne on the developing roller 22 unless the gradient force is applied to the toner, and as a result, a solid black followability failure is generated.

Effect of Embodiments 1, 3 and 4 on Fogging

In Comparative Example 6, the generation of fogging was observed in the case of "Used". In Embodiments 1, 3 and 4, on the other hand, the generation of fogging was not observed for both "New" and "Used". The reason why fogging was generated in Comparative Example 6 is probably as follows. The developing roller 22, according to Comparative Example 6, is configured such that the surface layer of the conductive portion 22*e* does not contain the resin particles. Therefore when the toner on the developing roller 22 that is being transported by the gradient force is rubbed by the regulating portion, the toner cannot receive sufficient force to be transferred on the developing roller 22 in the direction due to the surface of the conductive portion 22*e* which has been roughened. As a result, the charging function of the toner by the rolling motion became insufficient and a more conspicuous fogging was generated. In the case of the developing roller 22 according to Comparative Example 5, on the other hand, the toner which was transported to the regulation portion and passed the regulating portion is sufficiently charged by the conductive portion 22*e*, hence the generation of fogging was not observed.

Effect of Embodiments 1, 3 and 4 on Solid Black Image Uniformity

For both Comparative Example 5 and 6, the solid black image uniformity dropped. In Comparative Example 5, the solid black image uniformity probably dropped because the solid black followability dropped. In Comparative Example 6, the solid black image uniformity probably dropped because a toner feeding failure was generated in a region where the number of dielectric portions 22*d* is small, in the case of "Used" when the toner deterioration was advanced. In Embodiments 1, 3 and 4, on the other hand, a solid black image having high uniformity was acquired by a stable toner feeding, probably because the region where the number of dielectric portions 22*d* is small is generated is not generated very much in the direction orthogonal to the rotating direction of the developing roller 22, as in the case of Comparative Example 5. Further, in Embodiments 3 and 4, uniformity of the solid black image is even better than Embodiment 1.

In Embodiment 3, the dielectric portions 22*d* are continuously formed in the direction orthogonal to the rotating direction of the developing roller 22, hence a toner supply failure is less likely to be generated. However, in Embodiment 3. light horizontal lines of the density difference were visually recognized.

In Embodiment 4, on the other hand, there are many sections (inclined sections) which are inclined with respect to the rotation axis direction of the developing roller 22 at the boundaries between the dielectric portions 22*d* and the conductive portion 22*e*. Thereby when the toner rolls in the regulating portion where the developing roller 22 and the developing blade 23 contact, the toner moves in the rotation axis direction (longer direction) of the developing roller 22. This may be why the influence of nonuniformity of the toner feeding amount is further decreased, and uniformity of the solid black image further improves.

As described above, according to each embodiment, such image problems as fogging can be suppressed while suppressing the generation of a solid black image followability failure, even if deterioration or moisture absorption of the developer is generated, and an even better uniformity of the solid black image can be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-200557, filed on Oct. 25, 2018, and Japanese Patent Application No. 2018-200596, filed on Oct. 25, 2018 which are hereby incorporated by reference herein in their entirety.

What is claimed is:

1. A developing apparatus, comprising:

a developer bearing member configured to bear a developer; and a regulating member that is disposed in contact with a surface of the developer bearing member, and configured to regulate the developer borne on the developer bearing member, wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

2. The developing apparatus according to claim 1, wherein the second surface roughness is less than 0.8 μm.

3. The developing apparatus according to claim 1, wherein the first surface roughness is larger than a third surface roughness of a surface of the regulating member which faces the developer bearing member.

4. The developing apparatus according to claim 3, wherein the third surface roughness is larger than the second surface roughness.

5. The developing apparatus according to claim 1, wherein in a rotating direction of the developer bearing member, an average width of the dielectric portion is smaller than ½ of a contact width of a contact portion which is formed by the regulating member and the developer bearing member.

6. The developing apparatus according to claim 1, wherein the dielectric portion is formed on the surface of the developer bearing member, by coating a part of a surface of the conductive portion formed on the developer bearing member.

7. The developing apparatus according to claim 1, wherein on the surface of the developer bearing member, the dielectric portion is formed to be scattered in a region of the conductive portion.

8. The developing apparatus according to claim 7, wherein on the surface of the developer bearing member, a surface area occupied by the dielectric portion is smaller than a surface area occupied by the conductive portion.

9. The developing apparatus according to claim 1, wherein the developer is a nonmagnetic one-component developer.

10. A developer bearing member configured to bear a developer, comprising:

a conductive portion having a first surface roughness and a first electric resistance, disposed on a surface of the developer bearing member; and a dielectric portion having a second surface roughness, which is smaller than the first surface roughness, and a second electric resistance, which is larger than the first electric resistance, disposed on the surface of the developer bearing member, wherein in a case where the developer borne on the developer bearing member is charged by friction with a regulating member, which is disposed in contact with the surface of the developer bearing member and regulates developer borne on the developer bearing member, a charging polarity of the dielectric portion is the same polarity as a charging polarity of the developer.

11. A process cartridge, comprising:

a developer bearing member configured to bear a developer;

a regulating member that is disposed in contact with a surface of the developer bearing member, and configured to regulate the developer borne on the developer bearing member; and an image bearing member configured to bear a developer image;

wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

12. An image forming apparatus, comprising:

a developer bearing member configured to bear a developer;

a regulating member that is disposed in contact with a surface of the developer bearing member, and configured to regulate the developer borne on the developer bearing member;

an image bearing member configured to bear a developer image; and a transfer member, wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and in a case where the developer borne on the developer bearing member is charged by friction with the regulating member, a charging polarity of the dielectric portion is the same polarity as a charging polarity of the developer.

13. A developer bearing member configured to bear a developer and that is rotatable, comprising:

a conductive portion having a first surface roughness and a first electric resistance, disposed on a surface of the developer bearing member;

a dielectric portion having a second surface roughness, which is smaller than the first surface roughness, and a second electric resistance, which is larger than the first electric resistance, disposed on the surface of the developer bearing member, wherein an average width of the dielectric portion in an axis direction of a rotation axis of the developer bearing member is larger than an average width of the dielectric portion in a rotating direction of the developer bearing member which is orthogonal to the axis direction.

14. The developer bearing member according to claim 13, wherein in a case where the developer is charged by friction with a regulating member configured to regulate the developer borne on the developer bearing member, a charging polarity of the dielectric portion is the same polarity as a charging polarity of the developer.

15. The developer bearing member according to claim 13, wherein the dielectric portion has at least one outer peripheral section where an intersecting angle θ formed by a tangential line of an outer periphery of the dielectric portion and a line that is parallel with the rotation axis satisfies 0 (deg)<0<90 (deg) or 0 (deg)>0>−90 (deg), and in a case where an average particle diameter of the developer is denoted by D, the dielectric portion has the at least one outer peripheral section of which a width in the axis direction of the rotation axis is larger than 2 πD.

16. The developer bearing member according to claim 15, wherein the at least one outer peripheral section includes a plurality of the outer peripheral sections, and in a region that includes at least a part of the dielectric portion on the surface of the developer bearing member, among the plurality of outer peripheral sections of which a width in the axis direction of the rotation axis is more than 2 πD, when a number of the outer peripheral sections of which width is 50 μm or more is denoted by W1, and a number of the outer peripheral sections of which width is less than 50 μm is denoted by W2, W1 is W2 or larger.

17. The developer bearing member according to claim 15, wherein a ratio of the average width of the dielectric portion in the rotating direction of the developer bearing member, with respect to the average particle diameter of the developer, is at least 1.0.

18. The developer bearing member according to claim 13, wherein a ratio of the average width of the dielectric portion in the axis direction of the rotation axis of the developer bearing member, with respect to the average width of the dielectric portion in the rotating direction of the developer bearing member, is at least 1.4.

19. The developer bearing member according to claim 13, wherein the dielectric portion is formed on the surface of the developer bearing member by coating a part of the surface of the conductive portion formed on the developer bearing member.

20. The developer bearing member according to claim 13, wherein on the surface of the developer bearing member, the dielectric portion is formed to be scattered in a region of the conductive portion.

21. The developer bearing member according to claim 20, wherein on the surface of the developer bearing member, a surface area occupied by the dielectric portion is smaller than a surface area occupied by the conductive portion.

22. The developer bearing member according to claim 13, wherein the developer is a nomnagnetic one-component developer.

23. A developing apparatus, comprising:

a developer bearing member configured to bear developer; and a regulating member configured to regulate the developer borne on a surface of the developer bearing member;

wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

24. A process cartridge, comprising:

a developer bearing member configured to bear developer;

a regulating member configured to regulate the developer borne on a surface of the developer bearing member; and an image bearing member configured to bear a developer image;

wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

25. An image forming apparatus, comprising:

a developer bearing member configured to bear developer;

a regulating member configured to regulate the developer borne on a surface of the developer bearing member;

an image bearing member configured to bear a developer image; and a transfer member, wherein a conductive portion having a first surface roughness and a first electric resistance, and a dielectric portion having a second surface roughness, which is smaller than the first surface roughness, and a second electric resistance, which is larger than the first electric resistance, are disposed on the surface of the developer bearing member, and an average width of the dielectric portion in an axis direction of a rotation axis of the developer bearing member is larger than an average width of the dielectric portion in a rotating direction of the developer bearing member which is orthogonal to the axis direction.

* * * * *